US006365335B1

(12) United States Patent
Hioki et al.

(10) Patent No.: US 6,365,335 B1
(45) **Date of Patent: *Apr. 2, 2002**

(54) COMPOUND AND SILVER HALIDE PHOTOGRAPHIC MATERIAL CONTAINING THE SAME

(75) Inventors: Takanori Hioki; Kiyoshi Morimoto, both of Kanagawa (JP)

(73) Assignee: Fuji Photo Film Co., Ltd., Minami Ashigara (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/373,584

(22) Filed: Aug. 13, 1999

(30) Foreign Application Priority Data

Aug. 26, 1998 (JP) ..... 10-240635

(51) Int. Cl.[7] ..... G03C 1/12; G03C 1/18; G03C 1/20

(52) U.S. Cl. ..... 430/585; 430/583; 430/584; 430/586; 430/587; 430/591; 430/592; 430/593; 430/594; 430/595

(58) Field of Search ..... 430/585, 583, 430/584, 586, 587, 591, 592, 593, 594, 595

(56) References Cited

U.S. PATENT DOCUMENTS 4,387,155 A * 6/1983 Hill et al. ..... 430/574
5,254,455 A * 10/1993 Hinz et al. ..... 430/584
5,604,089 A * 2/1997 Ikegawa et al. ..... 430/584

* cited by examiner

*Primary Examiner*—Thorl Chea

(57) ABSTRACT

A Silver halide photographic material high in sensitivity and decreased in residual color is disclosed, which comprises at least one compound represented by the following formula (I):

(I)

wherein $Z_1$ represents an oxygen atom, a sulfur atom, a selenium atom, a tellurium atom, a carbon atom or a nitrogen atom; Q represents a group necessary for forming a methine dye; $M_1$ represents a charge equilibrium counter ion; $m_1$ represents the number necessary for neutralizing a charge of the molecule; $V_p$ represents a group having a log P value lower than that of Cl; $q_1$ represents 1, 2, 3 or 4; and $R_1$ is represented by following:

$R_1=(La)_{k1}CONHSO_2R_{11}$, $R_1=(Lb)_{k2}SO_2NHCOR_{12}$,
$R_1=(Lc)_{k3}CONHCOR_{13}$, $R_1=(Ld)_{k4}SO_2NHSO_2R_{14}$ wherein $R_{11}$, $R_{12}$, $R_{13}$ and $R_{14}$ each represents an alkyl group, an aryl group, a heterocyclic group, an alkoxyl group, an aryloxy group, a heterocyclyloxy group or an amino group; La, Lb, Lc and Ld each represents a methylene group; and k1, k2, k3 a nd k4 each represents an integer of 1 to 18.

8 Claims, 1 Drawing Sheet

COMPOUND AND SILVER HALIDE PHOTOGRAPHIC MATERIAL CONTAINING THE SAME

FIELD OF THE INVENTION

The present invention relates to a novel compound and a silver halide photographic material containing the same. More particularly, the present invention relates to a silver halide photographic material having high sensitivity and less residual color.

BACKGROUND OF THE INVENTION

A great deal of effort has hitherto been made for increasing the sensitivity of silver halide photographic materials and decreasing residual coloring (residual color) after processing. Sensitizing dyes used for spectral sensitization have been known to have significant influences on the characteristics of silver halide photographic materials. In the sensitizing dyes, the slight differences in structures thereof exert great influences on the photographic characteristics such as sensitivity, fogging and storage stability. However, it is difficult to previously predict the effects thereof, so that many investigators have hitherto made efforts to synthesize a number of sensitizing dyes and to examine the photographic characteristics thereof.

Tabular silver halide grains (hereinafter referred to as tabular grains) have the photographic characteristics that (1) The ratio of the surface area to the volume is high, which allows a sensitizing dye to be adsorbed on surfaces of the grains in large quantities. As a result, higher color sensitization sensitivity can be obtained;

(2) When an emulsion containing the tabular grains is applied and dried, the grains are arranged on a surface of a support in parallel therewith, which makes it possible to thin the thickness of a coating layer and improve the sharpness;

(3) The tabular grains arranged in parallel with the support maintain their shape and orientation even after development, so that the covering power of developed silver is high. This characteristic can more decrease the amount of silver coated necessary for obtaining the same blackening density, particularly in a roentgen film;

(4) The tabular grains oriented in parallel with the support are decreased in light scattering, so that an image high in resolution can be obtained; and (5) When the grains are used in a green-sensitive layer or a red-sensitive layer, a yellow filter can be decreased or removed from the emulsion, because of their low sensitivity to blue light.

U.S. Pat. No. 4,439,520 describes a color photographic material in which tabular grains having a thickness of less than 0.3 μm, a diameter of 0.6 μm or more and an aspect ratio of 8 or more are used in at least one layer of a green-sensitive emulsion layer and a red-sensitive emulsion layer, thereby improving the sharpness, the sensitivity and the graininess. The term "aspect ratio" as used herein means the ratio of the diameter to the thickness of the tabular grain. Further, the term "diameter of the tabular grain" means the diameter of a circle having the same area as the projected area of the grain observed under a microscope or an electron microscope. Furthermore, the thickness is indicated by the distance between two parallel faces constituting the tabular grain.

U.S. Pat. No. 4,693,964 describes a photographic element comprising tabular grains of silver bromide or silver iodobromide having a mean diameter of 0.4 μm to 0.55 μm and an aspect ratio of 8 or more. In this patent, tabular grains having a mean diameter of 0.5 μm and a thickness of 0.04 μm are described in an example. U.S. Pat. No. 4,672,027 describes a photographic element comprising tabular grains of silver bromide or silver iodobromide having a mean diameter of 0.22 μm to 0.55 μm and an aspect ratio of 8 or more. In this patent, tabular grains having a thickness of 0.04 μm are described in an example.

U.S. Pat. No. 5,250,403 describes a color photographic element containing tabular grains having (111) faces as a main plane, a mean diameter of 0.7 μm or more and a mean thickness of less than 0.07 μm in a minus blue (green and/or red) layer. The tabular grains having a mean thickness of less than 0.07 μm are hereinafter referred to as "extra thin" tabular grains. This patent describes that an emulsion of the extra thin tabular grains is attractive in the relationship between the sensitivity and the graininess, and that the use in the color photographic element, particularly in the minus blue recording emulsion layer, is advantageous because of the good sharpness of images.

European Patent 362,699 discloses tabular grains having a ratio of the aspect ratio to the diameter of the tabular grain of larger than 0.7. In this patent, the preparation of tabular grains having a thickness of 0.04 μm is described in an example.

Thus, for more highly exhibiting the characteristics of tabular grains, researches have hitherto been centralized on the development of tabular grains having a higher aspect ratio and a thinner thickness. On the other hand, the demand for higher qualities to photographs is strong, and the development of techniques which can attain the higher sensitivity has been desired.

As described above, the tabular grains are high in the ratio of the surface area to the volume, which allows a sensitizing dye to be adsorbed on surfaces of the grains in large quantities, as a result, higher color sensitization sensitivity can be obtained. In that case, in the sensitizing dye, an increase in light absorptivity is considered to improve the transmission efficiency of light energy to the silver halide, thereby attaining an increase in spectral sensitivity.

Thus, the tabular grains are advantageous for obtaining high color sensitization sensitivity. On the other hand, however, the sensitizing dye is adsorbed in large quantities, which introduces the problem that residual color after processing increases.

For the above-mentioned reasons, a sensitizing dye which is high in sensitivity and less in residual color has been desired.

SUMMARY OF THE INVENTION

An object of the present invention is to provide a novel compound.

Another object of the present invention is to provide a silver halide light-sensitive material comprising the novel compound, in which generation of fog is decreased, storage stability is excellent and residual color is decreased. As a result of intensive investigation, the objects of the present invention could be attained by the following (1) to (9):

(1) A silver halide photographic material comprising at least one compound represented by the following formula (I):

(I)

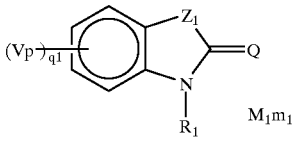

wherein $Z_1$ represents an oxygen atom, a sulfur atom, a selenium atom, a tellurium atom, a carbon atom or a nitrogen atom; Q represents a group necessary for forming a methine dye; $M_1$ represents a charge equilibrium counter ion; $m_1$ represents the number necessary for neutralizing a charge of the molecule; $V_P$ represents a group having a log P value lower than that of Cl; $q_1$ represents 1, 2, 3 or 4; and $R_1$ is represented by following:

$R_1=(La)_{k1}CONHSO_2R_{11}$, $R_1=(Lb)_{k2}SO_2NHCOR_{12}$, $R_1=(Lc)_{k3}CONHCOR_{13}$, $R_1=(Ld)_{k4}SO_2NHSO_2R_{14}$ wherein $R_{11}$, $R_{12}$, $R_{13}$ and $R_{14}$ each represents an alkyl group, an aryl group, a heterocyclic group, an alkoxyl group, an aryloxy group, a heterocyclyloxy group or an amino group; La, Lb, Lc and Ld each represents a methylene group; and k1, k2, k3 and k4 each represents an integer of 1 to 18;

(2) The silver halide photographic material described in (1), wherein $V_P$ is a fluorine atom;

(3) The silver halide photographic material described in (1) or (2), wherein the case that $k_1$ is 2 is excluded;

(4) The silver halide photographic material described in (1), wherein the compound represented by formula (I) is selected from a compound represented by the following formula (II):

(II)

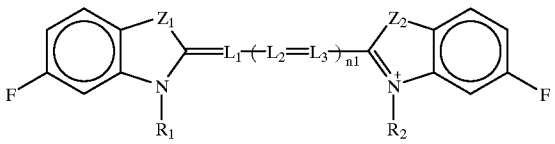

wherein $Z_1$, $R_1$, $M_1$ and $m_1$ each has the same meaning as given in formula (I); $Z_2$ represents an oxygen atom, a sulfur atom, a selenium atom, a tellurium atom, a carbon atom or a nitrogen atom; $R_2$ represents an alkyl group; $L_1$, $L_2$ and $L_3$ each represents a methine group; and $n_1$ represents 0, 1, 2 or 3;

(5) The silver halide photographic material described in (4), wherein the case that $k_1$ in formula (II) is 2 is excluded;

(6) The silver halide photographic material described in (1), wherein the compound represented by formula (I) is selected from a compound represented by the following formula (IIa):

(IIa)

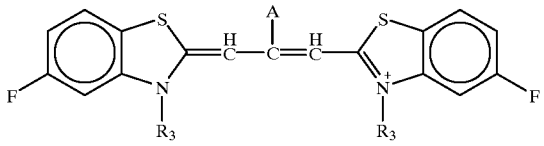

wherein $M_1$ and $m_1$ each has the same meaning as given in formula (I); A represents a hydrogen atom, a methyl group, an ethyl group or a propyl group; and $R_3$ is represented by following:

$R_3=CH_2CONHSO_2CH_3$, $R_3=CH_2SO_2NHCOCH_3$, $R_3=CH_2CONHCOCH_3$, $R_3=CH_2SO_2NHSO_2CH_3$ (7) The silver halide photographic material described in (1), wherein the compound represented by formula (I) is contained in an emulsion layer comprising silver halide grains having a mean aspect ratio of from 3 to 1,000.

(8) The silver halide photographic material described in (7), wherein the silver halide grains have a mean aspect ratio of from 8 to 100.

(9) A compound represented by formula (I):

(I)

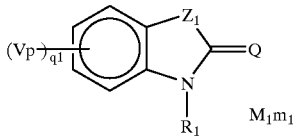

wherein $Z_1$ represents an oxygen atom, a sulfur atom, a selenium atom, a tellurium atom, a carbon atom or a nitrogen atom; Q represents a group necessary for forming a methine dye; $M_1$ represents a charge equilibrium counter ion; ml represents the number necessary for neutralizing a charge of the molecule; $V_P$ represents a group having a log P value lower than that of Cl; $q_1$ represents 1, 2, 3 or 4; and $R_1$ is represented by following:

$R_1=(La)_{k1}CONHSO_2R_{11}$, $R_1=(Lb)_{k2}SO_2NHCOR_{12}$, $R_1=(LC)_{k3}CONHCOR_{13}$, $R_1=(Ld)_{k4}SONHSO_2R_{14}$ wherein $R_{11}$, $R_{12}$, $R_{13}$ and $R_{14}$ each represents an alkyl group, an aryl group, a heterocyclic group, an aryloxy group, a heterocycloxy group or an amino group; La, Lb, Lc and Ld each represents a methylene group; and k1, k2, k3 and k4 each represents an integer of 1 to 18.

DETAILED DESCRIPTION OF THE INVENTION

Figure 1:
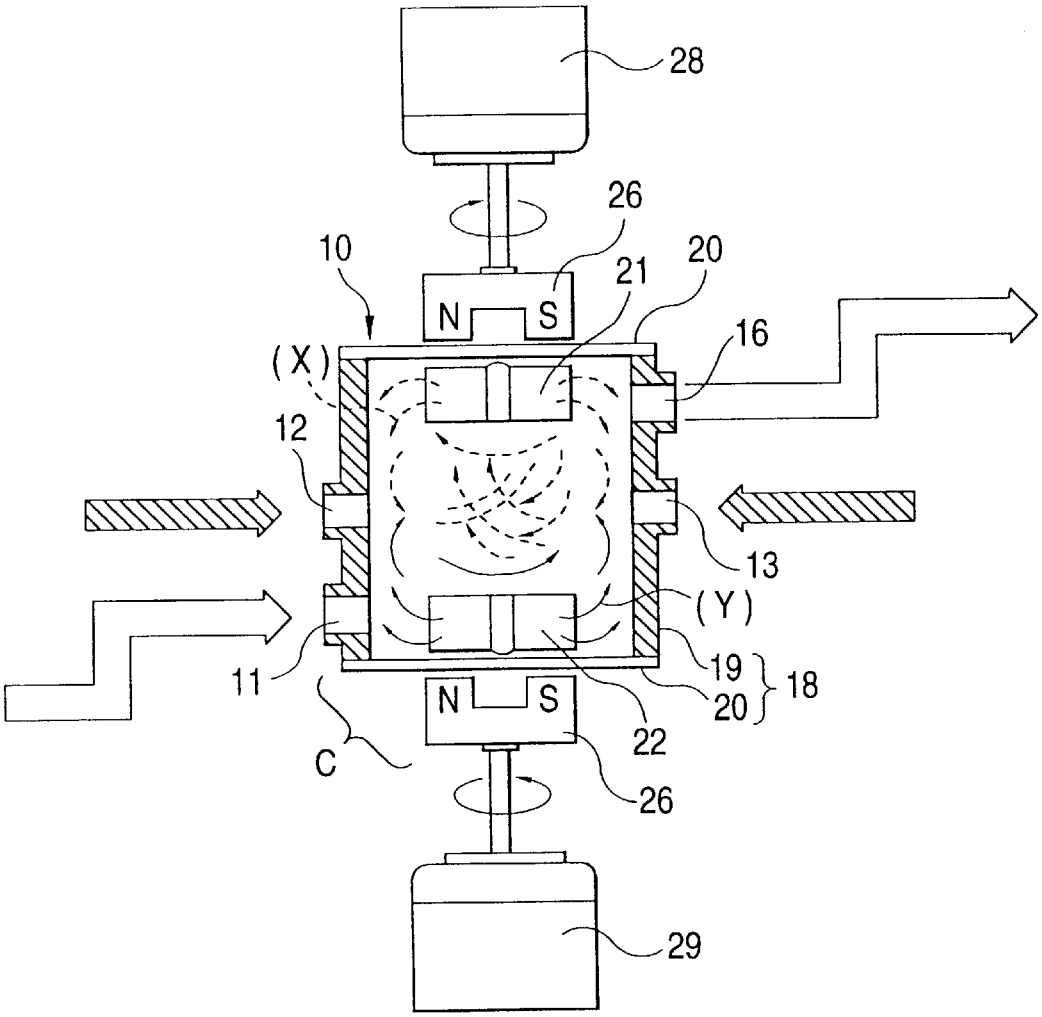
FIG. 1 is a cross sectional view showing a schematic structure of a stirring apparatus used in the present invention.

The compounds of formula (I) used in the present invention are described below in detail.

Although any methine dyes can be formed by Q, preferred examples thereof include cyanine dyes, merocyanine dyes, rhodacyanine dyes, trinuclear merocyanine dyes, allopolor dyes, hemicyanine dyes and styryl dyes. Details of these dyes are described in F. M. Harmer, *Heterocyclic Compounds-Cyanine Dyes and Related Compounds*, John Wiley & Sons, New York, London (1964) and D. M. Sturmer, *Heterocyclic Compounds-Special Topics in Heterocyclic Chemistry*, chapter 18, clause 14, pages 482 to 515.

The formulas of cyanine dyes, merocyanine dyes and rhodacyanine dyes are preferably ones described in U.S. Pat. No. 5,340,694, pages 21 and 22, (XI), (XII) and (XIII).

Further, when a cyanine dye is formed by Q in formula (I), it can also be expressed by a resonance formula as shown below:

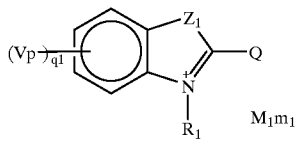

$M_1$ is contained in the formula for indicating the presence of a cation or an anion when required to neutralize the ion charge of the dye. Typical examples of the cations include inorganic cations such as a hydrogen ion (H–), alkali metal ions (for example, a sodium ion, a potassium ion and a lithium ion) and alkaline earth metal ions (for example, a calcium ion); and organic ions such as ammonium ions (for example, an ammonium ion, tetraalkylammonium ions, a pyridinium ion and an ethylpyridinium ion). The anions may be either inorganic anions or organic anions, and examples thereof include halogen anions (for example, a fluorine ion, a chlorine ion and a iodine ion), substituted arylsulfonic acid ions (for example, a p-toluenesulfonic acid ion and a p-chlorobenzenesulfonic acid ion), aryldisulfonic acid ions (for example, a 1,3-benzenesulfonic acid ion, a 1,5-naphthalenedisulfonic acid ion and a 2,6-naphthalenedisulfonic acid), alkylsulfuric acid ions (for example, a methylsulfuric acid ion), a sulfuric acid ion, a thiocyanic acid ion, a perchloric acid ion, a tetrafluoroboric acid ion, a picric acid ion, an acetic acid ion and a trifluoromethanesulfonic acid ion. Further, ionic polymers or other dyes having the charge adverse to that of the dyes may be used. Furthermore, $CO_2^-$ and $SO_3^-$ can also be indicated by $CO_2H$ and $SO_3H$, respectively, when they each has a hydrogen ion as a counter ion.

$m_1$ represents the number necessary for equilibrating the charge, and when a salt is formed in a molecule, it is 0.

In $R_1$, La, Lb, Lc and Ld are each an unsubstituted or substituted methylene group. Taking a substituent group as V, there is no particular limitation on the substituent group represented by V. However, examples thereof include halogen atoms (for example, chlorine, bromine, iodine and fluorine), mercapto, cyano, carboxyl, phosphoric acid, sulfo, hydroxyl, carbamoyl groups each having 1 to 10 carbon atoms, preferably 2 to 8 carbon atoms, more preferably 2 to 5 carbon atoms (for example, methylcarbamoyl, ethylcarbamoyl and morpholinocarbonyl), sulfamoyl groups each having 0 to 10 carbon atoms, preferably 2 to 8 carbon atoms, more preferably 2 to 5 carbon atoms (for example, methylsulfamoyl, ethylsulfamoyl and piperidinosulfonyl), nitro, alkoxyl groups each having 1 to 20 carbon atoms, preferably 1 to 10 carbon atoms, more preferably 1 to 8 carbon atoms (for example, methoxy, ethoxy, 2-methoxyethoxy and 2-phenylethoxy), aryloxy groups each having 6 to 20 carbon atoms, preferably 6 to 12 carbon atoms, more preferably 6 to 10 carbon atoms (for example, phenoxy, p-methylphenoxy, p-chlorophenoxy and naphthoxy), acyl groups each having 1 to 20 carbon atoms, preferably 2 to 12 carbon atoms, more preferably 2 to 8 carbon atoms (for example, acetyl, benzoyl and trichloroacetyl), acyloxy groups each having 1 to 20 carbon atoms, preferably 2 to 12 carbon atoms, more preferably 2 to 8 carbon atoms (for example, acetyloxy and benzoyloxy), acylamino groups each having 1 to 20 carbon atoms, preferably 2 to 12 carbon atoms, more preferably 2 to 8 carbon atoms (for example, acetylamino), sulfonyl groups each having 1 to 20 carbon atoms, preferably 1 to 10 carbon atoms, more preferably 1 to 8 carbon atoms (for example, methanesulfonyl, ethanesulfonyl and benzenesulfonyl), sulfinyl groups each having 1 to 20 carbon atoms, preferably 1 to 10 carbon atoms, more preferably 1 to 8 carbon atoms (for example, methanesulfinyl and benzenesulfinyl), sulfonylamino groups each having 1 to 20 carbon atoms, preferably 1 to 10 carbon atoms, more preferably 1 to 8 carbon atoms (for example, methanesulfonylamino, ethanesulfonylamino and benzenesulfonylamino), substituted amino groups each having 1 to 20 carbon atoms, preferably 1 to 12 carbon atoms, more preferably 1 to 8 carbon atoms (for example, methylamino, dimethylamino, benzylamino, anilino and diphenylamino), ammonium groups each having 0 to 15 carbon atoms, preferably 3 to 10 carbon atoms, more preferably 3 to 6 carbon atoms (for example, trimethylammonium and triethylammonium), hydrazino groups each having 0 to 15 carbon atoms, preferably 1 to 10 carbon atoms, more preferably 1 to 6 carbon atoms (for example, trimethylhydrazino), ureido groups each having 1 to 15 carbon atoms, preferably 1 to 10 carbon atoms, more preferably 1 to 6 carbon atoms (for example, ureido and N,N-dimethylureido), imido groups each having 1 to 15 carbon atoms, preferably 1 to 10 carbon atoms, more preferably 1 to 6 carbon atoms (for example, succinimido), alkylthio or arylthio groups each having 1 to 20 carbon atoms, preferably 1 to 12 carbon atoms, more preferably 1 to 8 carbon atoms (for example, methylthio, ethylthio, carboxyethylthio, sulfobutylthio and phenylthio), alkoxycarbonyl groups each having 2 to 20 carbon atoms, preferably 2 to 12 carbon atoms, more preferably 2 to 8 carbon atoms (for example, methoxycarbonyl, ethoxycarbonyl and benzyloxycarbonyl), aryloxycarbonyl groups each having 6 to 20 carbon atoms, preferably 6 to 12 carbon atoms, more preferably 6 to 8 carbon atoms (for example, phenoxycarbonyl), unsubstituted alkyl groups each having 1 to 18 carbon atoms, preferably 1 to 10 carbon atoms, more preferably 1 to 5 carbon atoms (for example, methyl, ethyl, propyl and butyl), substituted alkyl groups each having 1 to 18 carbon atoms, preferably 1 to 10 carbon atoms, more preferably 1 to 5 carbon atoms (for example, hydroxymethyl, trifluoromethyl, benzyl, carboxyethyl, ethoxycarbonylmethyl and acetylaminomethyl, wherein the substituted alkyl groups include unsaturated hydrocarbon groups each having preferably 2 to 18 carbon atoms, more preferably 3 to 10 carbon atoms, particularly preferably 3 to 5 carbon atoms (for example, vinyl, ethynyl, 1-cyclohexenyl, benzylidyne and benzylidene)), substituted or unsubstituted aryl groups each having 6 to 20 carbon atoms, preferably 6 to 15 carbon atoms, more preferably 6 to 10 carbon atoms (for example, phenyl, naphthyl, p-carboxyphenyl, p-nitrophenyl, 3,5-dichlorophenyl, p-cyanophenyl, m-fluorophenyl and p-tolyl), and heterocyclic groups, which may be substituted, each having 1 to 20 carbon atoms, preferably 2 to 10 carbon atoms, more preferably 4 to 6 carbon atoms (for example, pyridyl, 5-methylpyridyl, thienyl, furyl, morpholino and tetrahydrofurfuryl). Each of these substituent groups may further has V as a substituent.

Specifically, examples of the substituted methylene groups include methyl group-substituted methylene groups, ethyl group-substituted methylene groups, phenyl group-substituted methylene groups, hydroxyl group-substituted methylene groups and halogen atom- (for example, chlorine or bromine) substituted methylene groups.

La, Lb, Lc and Ld are each preferably an unsubstituted methylene group.

$k_1$, $k_2$, $k_3$ and $k_4$ each represents an integer of 1 to 18. $k_1$ is preferably 1, 3 or 4, more preferably 1 or 3, and particularly preferably 1. $k_2$, $k_3$ and $k_4$ are each preferably 1, 2, 3 or 4, more preferably 1 or 2, and particularly preferably 1. When $k_1$, $k_2$, $k_3$ and $k_4$ are each 2 or more, methylene groups are repeated, but are not required to be the same.

$R_{11}$, $R_{12}$, $R_{13}$ and $R_{14}$ each represents an alkyl group, an aryl group, a heterocyclic group, an alkoxyl group, an aryloxy group, a heterocyclyloxy group or an amino group. Preferred examples thereof include unsubstituted alkyl groups each having 1 to 18 carbon atoms, preferably 1 to 10 carbon atoms, more preferably 1 to 5 carbon atoms (for example, methyl, ethyl, propyl and butyl), substituted alkyl groups each having 1 to 18 carbon atoms, preferably 1 to 10 carbon atoms, more preferably 1 to 5 carbon atoms (for example, hydroxymethyl, trifluoromethyl, benzyl, carboxyethyl, ethoxycarbonylmethyl and acetylaminomethyl, wherein the substituted alkyl groups include unsaturated hydrocarbon groups each having preferably 2 to 18 carbon atoms, more preferably 3 to 10 carbon atoms, particularly preferably 3 to 5 carbon atoms (for example, vinyl, ethynyl, 1-cyclohexenyl, benzylidyne and benzylidene)), substituted or unsubstituted aryl groups each having 6 to 20 carbon atoms, preferably 6 to 15 carbon atoms, more preferably 6 to 10 carbon atoms (for example, phenyl, naphthyl, p-carboxyphenyl, p-nitrophenyl, 3,5-dichlorophenyl, p-cyanophenyl, m-fluorophenyl and p-tolyl), and heterocyclic groups, which may be substituted, each having 1 to 20 carbon atoms, preferably 2 to 10 carbon atoms, more preferably 4 to 6 carbon atoms (for example, pyridyl, 5-methylpyridyl, thienyl, furyl, morpholino and tetrahydrofurfuryl), alkoxyl groups each having 1 to 10 carbon atoms, preferably 1 to 8 carbon atoms (for example, methoxy, ethoxy, 2-methoxyethoxy, 2-hydroxyethoxy and 2-phenylethoxy), aryloxy groups each having 6 to 20 carbon atoms, preferably 6 to 12 carbon atoms, more preferably 6 to 10 carbon atoms (for example, phenoxy, p-methylphenoxy, p-chlorophenoxy and naphthoxy), heterocyclyloxy groups each having 1 to 20 carbon atoms, preferably 3 to 12 carbon atoms, more preferably 3 to 10 carbon atoms (for example, 2-thienyloxy and 2-morpholinooxy), and amino groups each having 0 to 20 carbon atoms, preferably 0 to 12 carbon atoms, more preferably 0 to 8 carbon atoms (for example, amino, methylamino, dimethylamino, ethylamino, diethylamino, hydroxyethylamino, benzylamino, anilino, diphenylamino, ring-forming morpholino and pyrrolidino). They may be further substituted by V described above.

Methyl, ethyl and hydroxyethyl are more preferred, an methyl is particularly preferred.

Preferred examples of $R_1$ are shown below:

$R_{1a}$=$CH_2CONHSO_2CH_3$, $R_{1b}$=$CH_2SO_2NHCOCH_3$, $R_{1c}$=$CH_2CONHCOCH_3$, $R_{1d}$=$CH_2SO_2NHSO_2CH_3$ $R_{1e}$=$CH_2CONHSO_2C_2H_5$, $R_{1f}$=$(CH_2)_3CONHSO_2CH_3$, $R_{1g}$=$(CH_2)_3SO_2NHCOCH_3$, $R_{1h}$=$(CH_2)_3CONHCOCH_3$, $R_{1i}$=$(CH_2)3SO_2NHSO_2CH_3$

They are preferred in this order, that is, $R_{1a}$ is most preferred.

The dissociation group NH of $R_1$ is indicated in an undissociated state, but it is also possible to become a dissociated form ($N^-$). Actually, either a dissociated state or an undissociated state is formed depending on the circumstances such as the pH in which a dye is placed.

As the notation, the group is indicated as, for example, $N^-$ in the dissociated state. When a cationic compound is present as a counter salt, the group is indicated as ($N^-$, $Na^+$). Even in the undissociated state, when the counter salt of the cationic compound is considered as a proton, the group can be indicated as ($N^-$, $H^+$).

Then, $V_P$ will be explained below. $V_P$ represents a group having a log P value lower than that of Cl (a chlorine atom). The definition of the log P value used in the present invention is described below. For the log P value of the substituent group $V_P$ or Cl, for example, taking $V_P$-substituted benzene as $V_P$-Bz or Cl-substituted benzene as Cl-Bz, log P of a molecule having them respectively is indicated as log P ($V_P$-Bz) or log P (Cl-Bz), which is considered as the log P value of the substituent group.

In the above, the log P value is the coefficient of octanol/water distribution measured. C log P is a calculated value of the above-mentioned coefficient. Accordingly, whenever the log P value is discussed in the present invention, the corresponding C log P value can be used as the log P value.

Methods for determining the log P value will be described. The log P value can be determined by the measurement according to a method described in (1) shown below. Further, the log P value can be determined by the calculation according to a fragment method described in (1) shown below, or a software package method described in (2) shown below:

(1) C. Hansch and A. J. Leo, *Substituent Constants for Correlation Analysis in Chemistry and Biology*, Jhon Wiley and Sons, New York (1979), and (2) Medchem Software Package (Version 3.54, developed and supplied by Pomona College, Claremont, Calif.).

$V_P$ may be any, as long as it satisfies the log P value. However, a fluorine atom, a hydrogen atom, a carboxyl group and a hydroxyl group are preferred, and a fluorine atom is particularly preferred. It is preferably substituted at the 5-position.

$q_1$ represents 1, 2, 3 or 4, and preferably 1. When $q_1$ is 2 or more, $V_P$ is repeated, but is not required to be the same.

Further, in general formula (I), the benzene nucleus having $V_P$ as the substituent group may have a substituent group other than $V_P$.

More preferably, the compound represented by formula (I) is selected from compounds represented by the following formula (III), (IV) or (V):

(III)

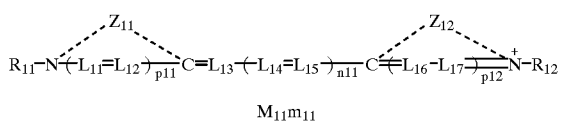

$M_{11}m_{11}$ wherein $L_{11}$, $L_{12}$, $L_{13}$, $L_{14}$, $L_{15}$, $L_{16}$ and $L_{17}$ each represents a methine group; $P_{11}$ and $P_{12}$ each represents 0 or 1; $n_{11}$ represents 0, 1, 2 or 3; $Z_{11}$ and $Z_{12}$ each represents an atom group necessary for forming a 5- or 6-membered nitrogen-containing heterocyclic ring, with which an aromatic ring may be condensed; $M_{11}$ represents a charge equilibrium counter ion; $m_{11}$ represents a number of 0 to 4 necessary for neutralizing a charge of the molecule; and $R_{11}$ and $R_{12}$ each represents an alkyl group, an aryl group or a heterocyclic group, with the proviso that either a nitrogen-containing heterocyclic moiety (*1) formed by $Z_{11}$ having the substituent group $R_{11}$ or a nitrogen-containing heterocyclic moiety (*2) formed by $Z_{12}$ having the substituent group $R_{12}$ is equal to a heterocyclic moiety (*3) represented by a portion in which =Q or —Q is excluded from formula (I).

*1:

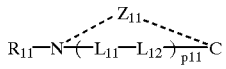

*2:

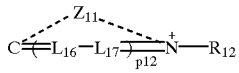

*3:

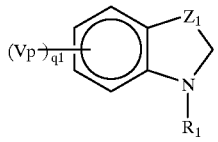

(IV)

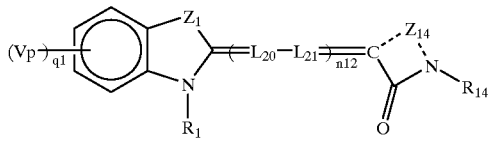

$M_{12}m_{12}$ wherein $Z_1$, $R_1$ $V_P$ and $q_1$ each has the same meaning as given in formula (I); $L_{20}$ and $L_{21}$ each represents a methine group; and $n_{12}$ represents 0, 1, 2 or 3; $M_{12}$ represents a charge equilibrium counter ion; $M_{12}$ represents a number of 0 to 4 necessary for neutralizing a charge of the molecule; and $R_{14}$ represents an alkyl group, an aryl group or a heterocyclic group.

*4:

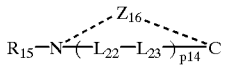

*5:

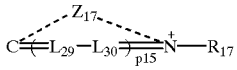

Of formulas (III), (IV) and (V), formula (III) is preferred.

The 5- or 6-membered nitrogen-containing heterocyclic ring represented by $Z_{11}$, $Z_{12}$, $Z_{15}$ and $Z_{17}$ in formulas (III) and (V) may be one condensed with an aromatic ring. The aromatic ring may be a benzene ring, a naphthalene ring or a heterocyclic aromatic ring such as a pyrazine ring or a thiophene ring.

Examples of the heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, 3,3-dialkylindolenine nuclei (for example, 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and pyrimidine nucleus.

A benzoxazole nucleus, a benzothiazole nucleus, a benzimidazole nucleus and a quinoline nucleus are preferred, and a benzoxazole nucleus and a benzothiazole nucleus are particularly preferred.

Substituent groups on $Z_{11}$, $Z_{12}$, $Z_{15}$ and $Z_{17}$ include V described above. They may each have a structure that a benzene ring, a naphthalene ring or an anthracene ring is condensed. Each of these substituent groups may further have V as a substituent group.

Preferred examples of the substituent groups on $Z_{11}$, $Z_{12}$, $Z_{15}$, and $Z_{17}$ include alkyl, aryl, alkoxyl, halogen, acyl, (V)

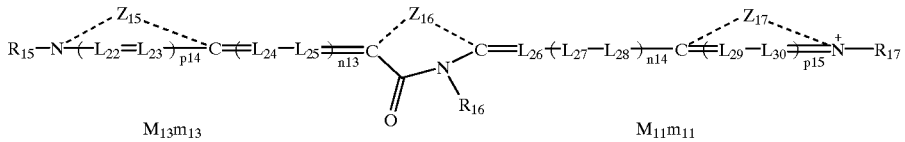

$M_{13}m_{13}$ $M_{11}m_{11}$ wherein $L_{22}$, $L_{23}$, $L_{24}$, $L_{25}$, $L_{26}$, $L_{27}$, $L_{28}$, $L_{29}$ and $L_{30}$ each represents a methine group; $P_{14}$ and $P_{15}$ each represents 0 or 1; $n_{13}$ and $n_{14}$ each represents 0, 1, 2 or 3; $Z_{15}$, $Z_{16}$ and $Z_{17}$ each represents an atom group necessary for forming a 5- or 6-membered nitrogen-containing heterocyclic ring, with which an aromatic ring may be condensed; $M_{13}$ represents a charge equilibrium counter ion; $m_{14}$ represents a number of 0 to 4 necessary for neutralizing a charge of the molecule; and $R_{15}$, $R_{16}$ and $R_{17}$ each represents an alkyl group, an aryl group or a heterocyclic group, with the proviso that either a nitrogen-containing heterocyclic moiety (*4) formed by $Z_{15}$ having the substituent group $R_{15}$ or a nitrogen-containing heterocyclic moiety (*5) formed by $Z_{17}$ having the substituent group $R_{17}$ is equal to a heterocyclic moiety (*3) represented by a portion in which =Q or —Q is excluded from formula (I).

cyano, sulfonyl and benzene ring-condensed ones described above. Alkyl, aryl, halogen, acyl, sulfonyl and benzene-condensed ones are more preferred, and methyl, phenyl, methoxy, fluorine, chlorine, bromine, iodine and benzene ring-condensed ones are particularly preferred. Phenyl, fluorine, chlorine, bromine and iodine are most preferred.

$R_{11}$, $R_{12}$, $R_{14}$, $R_{15}$, $R_{16}$ and $R_{17}$ each represents an alkyl group, an aryl group or a heterocyclic group. Examples thereof include unsubstituted alkyl groups each having 1 to 18 carbon atoms, preferably 1 to 7 carbon atoms, particularly preferably 1 to 4 carbon atoms (for example, methyl, ethyl, propyl, isopropyl, butyl, isobutyl, hexyl, octyl, dodecyl and octadecyl); substituted alkyl groups each having 1 to 18 carbon atoms, preferably 1 to 7 carbon atoms, particularly preferably 1 to 4 carbon atoms {examples thereof include the above-mentioned heterocyclic groups each having V as a substituent group, and preferred examples thereof include groups represented by $R_1$ such as aralkyl groups (for example, benzyl and 2-phenylethyl), unsaturated hydrocarbon groups (for example, allyl), hydroxy-alkyl groups (for example, 2-hydroxyethyl and 3-hydroxy-propyl), carboxy-alkyl groups (for example, 2-carboxyethyl, 3-carboxypropyl, 4-carboxybutyl and carboxymethyl), alkoxyalkyl groups (for example, 2-methoxyethyl and 2-(2-methoxyethoxy)ethyl), aryloxyalkyl groups (for example, 2-phenoxyethyl and 2-(1-naphthoxy)ethyl), alkoxycarbonylalkyl groups (for example, ethoxycarbonylmethyl and 2-benzyloxycarbonylethyl), aryloxycarbonylalkyl groups (for example, 3-phenoxycarbonylpropyl), acyloxyalkyl groups (for example, 2-acetyloxyethyl), acylalkyl groups (for example, 2-acetylethyl), carbamoylalkyl groups (for example, 2-morpholinocarbonylethyl), sulfamoylalkyl groups (for example, N,N-dimethylsulfamoylmethyl), sulfoalkyl groups (for example, 2-sulfoethyl, 3-sulfopropyl, 3-sulfobutyl, 4-sulfobutyl, 2-[3-sulfopropoxy]ethyl, 2-hydroxy-3-sulfopropyl and 3-sulfopropoxyethoxyethyl), sulfoalkenyl groups, sulfatoalkyl groups (for example, 2-sulfatoethyl, 3-sulfatopropyl and 4-sulfatobutyl), heterocyclic ring-substituted alkyl groups (for example, 2-(pyrrolidine-2-one-1-yl)ethyl and tetrahydrofurfuryl) and alkylsulfonylcarbamoylmethyl groups (for example, methanesulfonylcarbamoylmethyl); unsubstituted aryl groups each having 6 to 20 carbon atoms, preferably 6 to 10 carbon atoms, more preferably 6 to 8 carbon atoms (for example, phenyl and 1-naphthyl); substituted aryl groups each having 6 to 20 carbon atoms, preferably 6 to 10 carbon atoms, more preferably 6 to 8 carbon atoms (examples thereof include the above-mentioned aryl groups each having V as a substituent group, and specific examples thereof include p-methoxyphenyl, p-methylphenyl and p-chlorophenyl); unsubstituted heterocyclic groups each having 1 to 20 carbon atoms, preferably 3 to 10 carbon atoms, more preferably 4 to 8 carbon atoms (for example, 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazole), 3-(1,2,4-triazole) and 5-tetrazolyl; and substituted heterocyclic groups each having 1 to 20 carbon atoms, preferably 3 to 10 carbon atoms, more preferably 4 to 8 carbon atoms (examples thereof include the above-mentioned heterocyclic groups each having V as a substituent group, and preferred examples thereof include 5-methyl-2-thienyl and 4-methoxy-2-pyridyl).

Preferred examples of $R_{11}$, $R_{12}$, $R_{14}$, $R_{15}$, $R_{16}$ and $R_{17}$ include the above-mentioned carboxyalkyl groups, sulfoalkyl groups, unsubstituted alkyl groups and $R_1$ of the present invention. More preferably, they are methyl, ethyl, 2-sulfoethyl, 3-sulfopropyl, 3-sulfobutyl, 4-sulfobutyl, carboxymethyl, phenyl, 2-pyridyl, 2-thiazolyl and $R_1$ of the present invention.

$Z_{14}$ represents an atom group necessary for forming an acidic nucleus, and may form any general acidic nucleus of a merocyanine dye. The term "acidic nucleus" as used herein is defined in, for example, James, *The Theory of the Photographic Process*, 4th ed., page 198, Macmillan (1977). Specific examples thereof include acidic nuclei described in U.S. Pat. Nos. 3,567,719, 3,575,869, 3,804,634, 3,837,862, 4,002,480 and 4,925,777 and JP-A-3-167546 (the term "JP-A" as used herein means an "unexamined published Japanese patent application").

When the acidic nuclei form 5- or 6-membered nitrogen-containing heterocyclic rings comprising carbon, nitrogen and chalcogen (typically, oxygen, sulfur, selenium and tellurium) atoms, preferred examples of the nuclei include 2-pyrazolin-5-one, pyrazolidine-3,5-dione, imidazoline-5-one, hydantoin, 2- or 4-thiohydantoin, 2-iminooxazolidine-4-one, 2-oxazoline-5-one, 2-thiooxazoline-2,4-dione, isoxazoline-5-one, 2-thiazoline-4-one, thiazolidine-4-one, thioxazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione barbituric acid, 2-thiobarbituric acid, chroman-2,4-dione, indazoline-2-one, pyrido[1,2-a]pyrimidine-1,3-dione, pyrazolo[1,5-a]quinazolone, pyrazlo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide nuclei.

$Z_{14}$ is preferably hydantoin, 2- or 4-thiohydantoin, 2-oxazoline-5-one, 2-thiooxazoline-2,4-dione, thioxazolidine-2,4-dione, rhodanine, thiazolidine-2,4-dithione, barbituric acid and 2-thiobarbituric acid, more preferably hydantoin, 2- or 4-thiohydantoin, 2-oxazoline-5-one, rhodanine, barbituric acid and 2-thiobarbituric acid, and particularly preferably 2- or 4-thiohydantoin, 2-oxaz oline-5-one an d rhodanine.

The 5- or 6-membered nitrogen-containing heterocyclic rings formed by $Z_{16}$ are ones in which oxo groups or thioxo groups are removed from the heterocyclic rings represented by $Z_{14}$. They are preferably ones in which oxo groups or thioxo groups a re removed from hydantoin, 2- or 4-thiohydantoin, 2-oxazoline-5-one, 2-thiooxazoline-2,4-dione, thioxazolidine-2,4-dione, rhodanine, thiazolidine-2,4-dithione, barbituric acid and 2-thiobarbituric acid, more preferably ones in which oxo groups or thioxo groups are removed from hydantoin, 2- or 4-thiohydantoin, 2-oxazoline-5-one, rhodanine, barbituric acid and 2-thiobarbituric acid, and particularly preferably ones in which oxo groups or thioxo groups are removed from 2- or 4-thiohydantoin, 2-oxazoline-5-one and rhodanine.

$L_1$, $L_2$, $L_3$, $L_{11}$, $L_{12}$, $L_{13}$, $L_{14}$, $L_{15}$, $L_{16}$, $L_{17}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each independently represents a methine group. The above-mentioned methine group represented by $L_1$ to $L_{30}$ may have a substituent group. Examples of the substituent groups include substituted or unsubstituted alkyl groups each having 1 to 15 carbon atoms, preferably 1 to 10 carbon atoms, more preferably 1 to 5 carbon atoms (for example, methyl, ethyl and 2-carboxyethyl), substituted or unsubstituted aryl groups each having 6 to 20 carbon atoms, preferably 6 to 15 carbon atoms, more preferably 6 to 10 carbon atoms (for example, phenyl and o-carboxyphenyl), substituted or unsubstituted heterocyclic groups each having 3 to 20 carbon atoms, preferably 4 to 15 carbon atoms, more preferably 6 to 10 carbon atoms (for example, N,N-diethylbarbituric acid), halogen atoms (for example, chlorine, bromine, fluorine and iodine), alkoxyl groups each having 1 to 15 carbon atoms, preferably 1 to 10 carbon atoms, more preferably 1 to 5 carbon atoms (for example, methoxy and ethoxy), alkylthio groups each having 1 to 15 carbon atoms, preferably 1 to 10 carbon atoms, more preferably 1 to 5 carbon atoms (for example, methylthio and ethylthio), arylthio groups each having 6 to 20 carbon atoms, preferably 6 to 15 carbon atoms, more preferably 6 to 10 carbon atoms (for example, phenylthio), and amino groups each having 0 to 15 carbon atoms, preferably 2 to 10 carbon atoms, more preferably 4 to 10 carbon atoms (for example, N,N-diphenylamino, N-methyl-N-phenylamino and N-methylpiperazino). They may form rings with other methine groups, or can also form rings together with $Z_{11}$, $Z_{12}$, $Z_{15}$, and $Z_{16}$.

$n_1$, $n_{11}$, $n_{12}$ and $n_{13}$ are each preferably 0, 1 or 2, more preferably 0 or 1, and particularly preferably 1. $n_{14}$ is preferably 0 or 1, and more preferably 0. When $n_1$, $n_{11}$, $n_{12}$, $n_{13}$ and $n_{14}$ are each 2 or more, methine groups are repeated, but are not required to be the same.

In general formula (II), it is most preferred that $n_1$=1, $L_1$ and $L_3$ are unsubstituted methine groups, and $L_2$ is an ethyl-substituted methine group.

$M_{11}$, $M_{12}$ and $M_{13}$ have the same meaning as given for $M_1$, and $m_{11}$, $m_{12}$ and $M_{13}$ have the same meaning as given for $m_1$. Similar ones are preferred.

$P_{11}$, $P_{12}$, $P_{14}$ and $P_{15}$ each independently represents 0 or 1, and preferably 0.

$Z_1$ and $Z_2$ each represents an oxygen atom, a sulfur atom, a selenium atom, a tellurium atom, a carbon atom or a nitrogen atom. In the case of a carbon atom or a nitrogen atom, it may have an alkyl group, an aryl group or a heterocyclic group given in V described above as a substituent group (when it has no substituent group, it represented by $CH_2$ or NH).

$Z_1$ and $Z_2$ are each preferably an oxygen atom or a sulfur atom, and more preferably a sulfur atom.

A represents a methyl group, an ethyl group or a propyl group, and preferably an ethyl group.

$R_3$ is preferred in the order of $CH_2CONHSO_2CH_3$, $CH_2SO_2NHCOCH_3$, $CH_2CONHCOCH_3$ and $CH_2SO_2NHSO_2CH_3$. $CH_2CONHSO_2CH_3$ is most preferred.

Specific examples of the compounds represented by formula (I) of the present invention (including formulas (II), (IIa), (III), (IV) and (V) which are subordinate concepts of formula (I)) are shown below, but the present invention is not limited thereby.

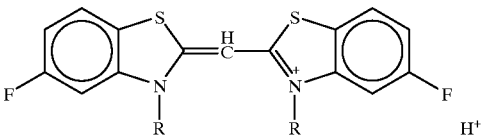

(1): R = $CH_2CO\overline{N}SO_2CH_3$ (2): R = $CH_2SO_2\overline{N}COCH_3$
(3): R = $CH_2CO\overline{N}COCH_3$ (4): R = $CH_2SO_2\overline{N}SO_2CH_3$
(5): R = $(CH_2)_3CO\overline{N}SO_2CH_3$ (6): R = $(CH_2)_3SO_2\overline{N}COCH_3$

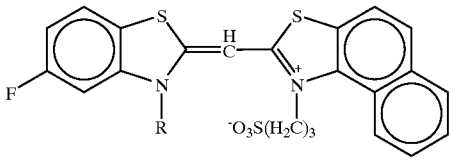

(7): R = $CH_2CONHSO_2CH_3$ (8): R = $CH_2SO_2NHCOCH_3$
(9): R = $CH_2CONHCOCH_3$ (10): R = $CH_2SO_2NHSO_2CH_3$
(11): R = $(CH_2)_3CONHSO_2CH_3$ (12): R = $(CH_2)_3SO_2NHCOCH_3$

-continued

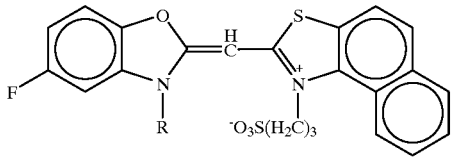

(13): R = $CH_2CONHSO_2CH_3$ (14): R = $CH_2SO_2NHCOCH_3$
(15): R = $CH_2CONHCOCH_3$ (16): R = $CH_2SO_2NHSO_2CH_3$
(17): R = $(CH_2)_3CONHSO_2CH_3$ (18): R = $(CH_2)_3SO_2NHCOCH_3$

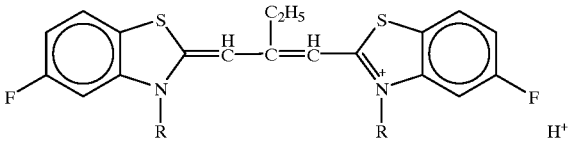

(19): R = $CH_2CO\overline{N}SO_2CH_3$ (20): R = $CH_2SO_2\overline{N}COCH_3$
(21): R = $CH_2CO\overline{N}COCH_3$ (22): R = $CH_2SO_2\overline{N}SO_2CH_3$
(23): R = $(CH_2)_3CO\overline{N}SO_2CH_3$ (24): R = $(CH_2)_3SO_2\overline{N}COCH_3$

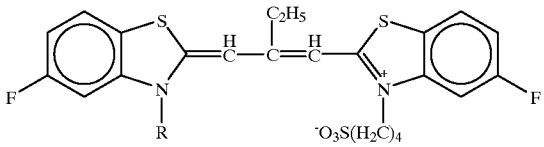

(25): R = $CH_2CONHSO_2CH_3$ (26): R = $CH_2SO_2NHCOCH_3$
(27): R = $CH_2CONHCOCH_3$ (28): R = $CH_2SO_2NHSO_2CH_3$
(29): R = $(CH_2)_3CONHSO_2CH_3$ (30): R = $(CH_2)_3SO_2NHCOCH_3$

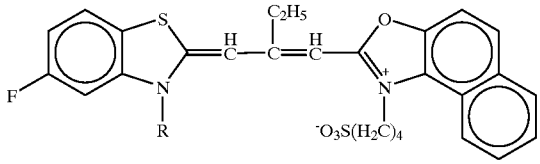

(31): R = $CH_2CONHSO_2CH_3$ (32): R = $CH_2SO_2NHCOCH_3$
(33): R = $CH_2CONHCOCH_3$ (34): R = $CH_2SO_2NHSO_2CH_3$
(35): R = $(CH_2)_3CONHSO_2CH_3$ (36): R = $(CH_2)_3SO_2NHCOCH_3$

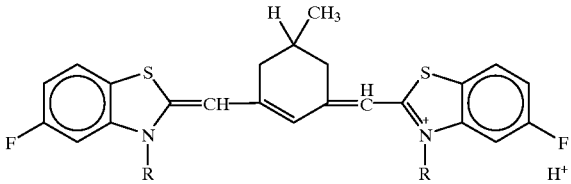

(37): R = $CH_2CO\overline{N}SO_2CH_3$ (38): R = $CH_2SO_2\overline{N}COCH_3$
(39): R = $CH_2CO\overline{N}COCH_3$ (40): R = $CH_2SO_2\overline{N}SO_2CH_3$
(41): R = $(CH_2)_3CO\overline{N}SO_2CH_3$ (42): R = $(CH_2)_3SO_2\overline{N}COCH_3$

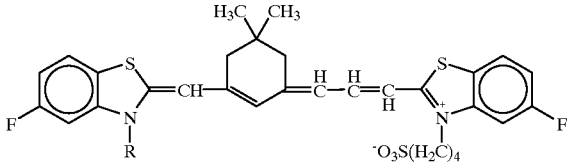

(43): R = $CH_2CONHSO_2CH_3$ (44): R = $CH_2SO_2NHCOCH_3$
(45): R = $CH_2CONHCOCH_3$ (46): R = $CH_2SO_2NHSO_2CH_3$
(47): R = $(CH_2)_3CONHSO_2CH_3$ (48): R = $(CH_2)_3SO_2NHCOCH_3$

-continued

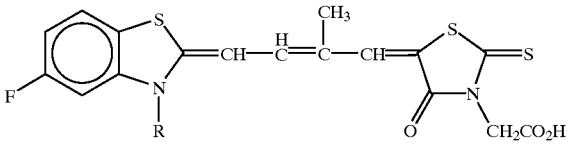

(49): R = $CH_2CONHSO_2CH_3$ (50): R = $CH_2SO_2NHCOCH_3$ (51): R = $CH_2CONHCOCH_3$ (52): R = $CH_2SO_2NHSO_2CH_3$ (53): R = $(CH_2)_3CONHSO_2CH_3$ (54): R = $(CH_2)_3SO_2NHCOCH_3$

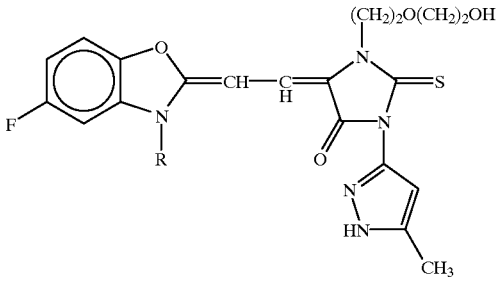

(55): R = $CH_2CONHSO_2CH_3$ (56): R = $CH_2SO_2NHCOCH_3$ (57): R = $CH_2CONHCOCH_3$ (58): R = $CH_2SO_2NHSO_2CH_3$ (59): R = $(CH_2)_3CONHSO_2CH_3$ (60): R = $(CH_2)_3SO_2NHCOCH_3$

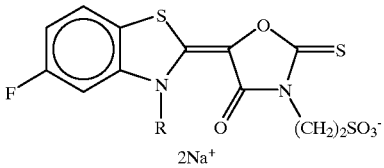

(61): R = $CH_2CO\bar{N}SO_2CH_3$ (62): R = $CH_2SO_2\bar{N}COCH_3$ (63): R = $CH_2CO\bar{N}COCH_3$ (64): R = $CH_2SO_2\bar{N}SO_2CH_3$ (65): R = $(CH_2)_3CO\bar{N}SO_2CH_3$ (66): R = $(CH_2)_3SO_2\bar{N}COCH_3$

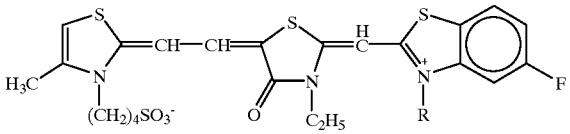

(67): R = $CH_2CONHSO_2CH_3$ (68): R = $CH_2SO_2NHCOCH_3$ (69): R = $CH_2CONHCOCH_3$ (70): R = $CH_2SO_2NHSO_2CH_3$ (71): R = $(CH_2)_3CONHSO_2CH_3$ (72): R = $(CH_2)_3SO_2NHCOCH_3$

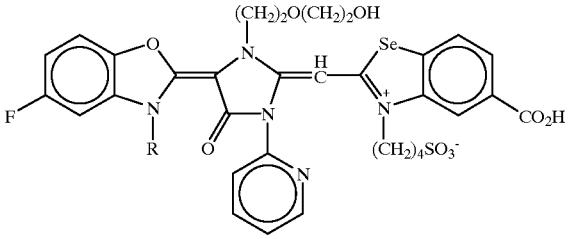

(73): R = $CH_2CONHSO_2CH_3$ (74): R = $CH_2SO_2NHCOCH_3$ (75): R = $CH_2CONHCOCH_3$ (76): R = $CH_2SO_2NHSO_2CH_3$ (77): R = $(CH_2)_3CONHSO_2CH_3$ (78): R = $(CH_2)_3SO_2NHCOCH_3$ (79)

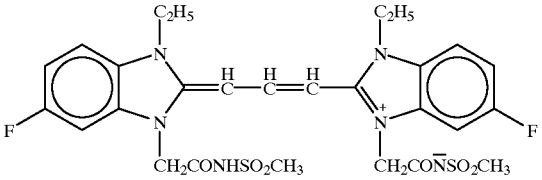

-continued (80)

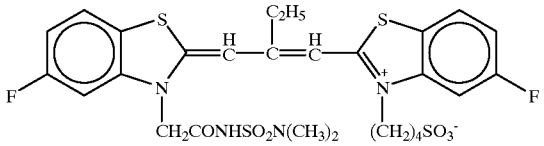

(81)

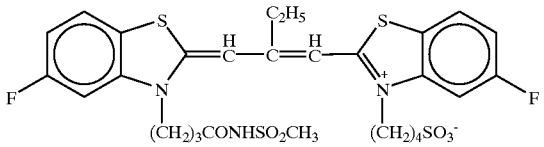

(82)

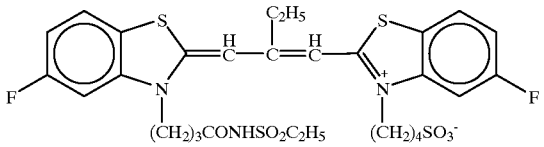

(83)

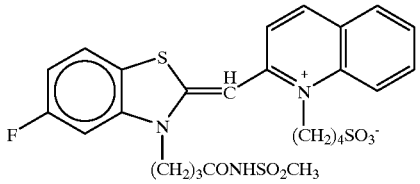

(84)

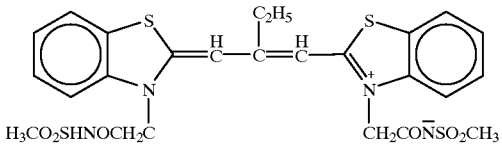

(85)

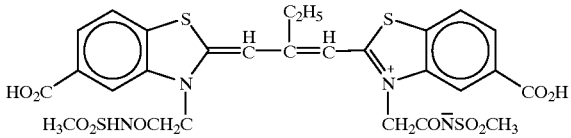

(86)

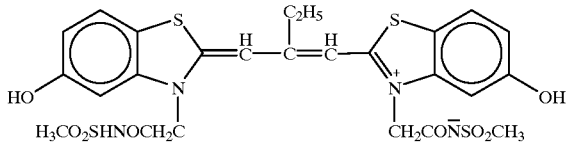

The compounds represented by formula (I) of the present invention (including formulas (II), (III), (IV) and (V) which are subordinate concepts of general formula (I)) can be synthesized according to methods described in F. M. Harmer, *Heterocyclic Compounds-Cyanine Dyes and Related Compounds*, John Wiley & Sons, New York, London (1964), D. M. Sturmer, *Heterocyclic Compounds-Special Topics in Heterocyclic Chemistry*, chapter 18, clause 14, pages 482 to 515, John Wiley & Sons, New York, London (1977), and Rodd's Chemistry of Carbon Compounds, 2nd ed. vol. IV, part B, chapter 15, pages 369 to 422, Elsevier Science Publishing Company Inc., New York (1977).

The compounds of the present invention represented by general formulas (1) to (V) (hereinafter referred to as the compounds of the present invention) may be used alone, but the use thereof in combination with other spectral sensitizing dyes is better.

The silver halide photographic materials of the present invention will be described below in detail.

The compounds of the present invention are used in photographic materials having the following uses as sensitizing agents, sensitizing dyes and filters, and for antihalation or prevention of irradiation. These dyes can be added to desired layers such as intermediate layers, protective layers and back layers, in addition to light-sensitive emulsion layers. Particularly preferably, they are used as the sensitizing dyes.

The compounds of the present invention are used in various color and black-and-white silver halide photographic materials.

More particularly, they are used in color positive light-sensitive materials, color paper light-sensitive materials, color negative light-sensitive materials, color reversal light-sensitive materials (containing couplers or not, depending on the circumstances), direct positive silver halide photographic materials, plate-making photographic materials (for example, lith films and lith duplicating films), light-sensitive materials for cathode ray tube displays, X-ray recording light-sensitive materials (particularly, light-sensitive material for direct and indirect radiography using screens), light-sensitive materials used in the silver salt diffusion transfer process, light-sensitive materials used in the color diffusion transfer process, light-sensitive materials used in the dye transfer process (inhibition process), light-sensitive materials used in the silver dye bleaching process, and heat developable light-sensitive materials.

The silver halide which can be used in the silver halide photographic material of the present invention may be any of silver bromide, silver iodobromide, silver iodochlorobromide, silver chlorobromide and silver chloride. Preferred examples of the silver halides are silver bromide, silver chlorobromide, silver iodochlorobromide and a silver halide having high silver chloride content described in JP-A-2-42.

Although the constitution and processing of the photographic materials are described below, the constitution and processing described in JP-A-2-42 are particularly preferably used in the silver halide having high silver chloride content.

Further, the constitution and processing described in JP-A-63-264743 are particularly preferably used in silver chlorobromide.

The silver halide grain may have phases different from each other in the inside and a surface layer thereof, or may be made of an uniform phase. Further, the silver halide grain may be either a grain in which a latent image is mainly formed on a surface of the grain (for example, a negative type photographic material) or a grain in which a latent image is mainly formed in the inside of the grain (for example, an internal latent image type photographic material) or a grain whose surface is previously fogged (for example, a direct positive type photographic material).

The silver halide grains having the above-mentioned various halogen compositions, crystal habits, structures in grains, shapes and distributions are used in photographic materials (elements) for various uses.

The silver halide grains contained in the photographic materials may have a regular crystal form such as a cubic, an a tetradecahedral or a rhombododecahedral form, an irregular crystal form such as a spherical or a tabular form, or a combined form of these crystal forms. They may be composed of mixtures of grains having various crystal forms.

The silver halide photographic emulsions used in the present invention can be prepared using, for example, methods described in P. Glafkides, *Chemie et Physique Photographique* (Paul Montel, 1967), G. F. Duffin, *Photographic Emulsion Chemistry* (The Focal Press, 1966) and V. L. Zelikman et al., *Making and Coating Photographic Emulsion* (The Focal Press, 1964).

For controlling the growth of grains in the preparation of the silver halide grains, for example, ammonia, potassium rhodanide, ammonium rhodanide, thioether compounds (for example, U.S. Pat. Nos. 3,271,157, 3,574,628, 3,704,130, 4,297,439 and 4,276,374), thione compounds (for example, JP-A-53-144319, JP-A-53-82408 and JP-A-55-77737) and amine compounds (for example, JP-A-54-100717) can be used as solvents for silver halides.

In the course of formation of the silver halide grains and physical ripening, cadmium salts, zinc salts, thallium salts, iridium salts or complex salts thereof, rhodium salts or complex salts thereof, and iron salts or complex salts thereof may be allowed to coexist.

The internal latent image type silver halide emulsions used in the present invention include, for example, conversion type silver halide emulsions, core/shell type silver halide emulsions and silver halide emulsions containing foreign metals described in U.S. Pat. Nos. 2,592,250, 3,206,313, 3,447,927, 3,761,276 and 3,935,014.

The silver halide emulsions which can be used in the silver halide photographic materials of the present invention are preferably emulsions comprising tabular silver halide grains having a higher surface area/volume ratio which allow the sensitizing dyes disclosed in the present invention to be adsorbed. The aspect ratio is preferably 3 to 1000, more preferably 8 to 1000, still more preferably 8 to 100, yet more preferably 15 to 80 and most preferably 20 to 80. The term "an aspect ratio of 3 to 1000" as used herein means that silver halide grains having an aspect ratio (equivalent-circle diameter of silver halide grain/thickness of grain) of 3 to 1000 occupy 50% or more of the projected area of the total silver halide grains in the emulsion, preferably 70% or more, and more preferably 85% or more. The thickness of the tabular grains is less than 0.2 $\mu$m, preferably less than 0.1 $\mu$m, and more preferably less than 0.07 $\mu$m. For preparing such high aspect ratio and thin tabular grains, the following processes are applied.

First, methods for preparing the silver halide emulsions of the present invention are described in more detail.

The silver halide emulsions of the present invention can be produced by the stages of nucleation→ripening→growth.

The respective stages of nucleation, ripening and growth will be described below.

1. Nucleation

For the nucleation of tabular grains, a double jet process conducted by adding an aqueous solution of a silver salt and an aqueous solution of an alkali halide to a reaction vessel retaining an aqueous solution of a protective colloid, or a single jet method of adding an aqueous solution of a silver salt to a protective colloid solution containing an alkali halide is generally used. Further, a method of adding an aqueous solution of an alkali halide to a protective colloid solution containing a silver salt can also be used as so desired. Furthermore, a protective colloid solution, a silver salt solution and an aqueous solution of an alkali halide can also added to a mixer disclosed in JP-A-2-44335, and immediately transferred to a reaction vessel, thereby conducting the nucleation of the tabular grains, so required. As disclosed in U.S. Pat. No. 5,104,786, the nucleation can also be performed by passing an aqueous solution containing an alkali halide and a protective colloid solution through a pipe, and adding an aqueous solution of a silver salt thereto.

Although gelatin is used as the protective colloid, a natural polymer other than gelatin or a synthetic polymer is also similarly used. As the kind of gelatin, alkali-treated gelatin, oxidation-treated gelatin in which methionine groups in the gelatin molecule are oxidized with hydrogen peroxide (the methionine content is 40 $\mu$mol/g or less), amino group-modified gelatin (for example, phthalated gelatin, trimellited gelatin, succinated gelatin, maleated gelatin or esterified gelatin) or low-molecular weight gelatin (molecular weight: 3000 to 40000) is used. Further, natural polymers are described in JP-B-7-111550 (the term "JP-B" as used herein means an "examined Japanese patent publication") and *Research Disclosure*, 176, No. 17643, IX, (December, 1978).

Excess halogen salts in the nucleation of the present invention are $Cl^-$, $Br^-$ and $I^-$, and may exist alone or in combination. The concentration is from $3\times10^{-5}$ mol/liter to 0.1 mol/liter, and preferably from $3\times10^{-4}$ mol/liter to 0.01 mol/liter.

The temperature in the nucleation is preferably from 5° C. to 60° C. However, when fine tabular grains having a mean grain size of 0.5 $\mu$m or less are produced, the temperature is preferably from 5° C. to 48° C.

When amino group-modified gelatin is used, the pH of a dispersion medium is preferably from 4 to 8, and when other gelatin is used, the pH is preferably from 2 to 8.

2. Ripening

In the nucleation described in item 1 above, fine grains (particularly, octahedrons and single twin grains) other than tabular grains are formed. Before entering a growth stages described below, it is necessary to allow the grains other than tabular grains to disappear and to obtain nuclei having a shape to form the tabular grains and good mono dispersibility. In order to make this possible, it is well known that the nucleation is followed by Ostwald ripening.

Immediately after the nucleation, the pBr is adjusted, and then, the temperature is elevated to conduct the ripening until the ratio of hexagonal tabular grains reaches the maximum value. At this time, the protective colloid solution may be additionally added. In that case, the concentration of the protective colloid based on the dispersion medium solution is preferably 10% by weight or less. The protective colloids additionally added at this time include the above-mentioned alkali-treated gelatin, amino group-modified gelatin, oxidation-treated gelatin, low-molecular weight gelatin, natural polymers and synthetic polymers.

The ripening temperature is from 40° C. to 80° C., and preferably from 50° C. to 80° C. The pBr is from 1.2 to 3.0. Further, when amino group-modified gelatin is present, the pH is preferably from 4 to 8, but in the case of the other gelatin, it is preferably from 2 to 8.

Further, for allowing the grains other than the tabular grains to disappear rapidly at this time, a solvent for a silver halide (i.e., a silver halide solvent) may be added. In this case, the concentration of the solvent for the silver halide is preferably 0.3 mol/liter or less, and more preferably less than 0.2 mol/liter or less. When the emulsion is used as a direct reversal emulsion, the solvent for the silver halide such as a thioether compound used on the neutral or acidic side is more preferred than $NH_3$ used on the alkaline side as the solvent for the silver halide.

Thus, the grains are converted to approximately 100% tabular grains by the ripening.

After the ripening is completed, when the solvent for the silver halide is not required in the subsequent growth stage, it is removed as follows:

(1) For the alkaline solvent for the silver halide such as $NH_3$, an acid having a high solubility product with $Ag^+$ such as $HNO_3$ is added to invalidate the solvent; and (2) For the thioether solvent for the silver halide, an oxidant such as $H_2O_2$ is added to invalidate the solvent, as described in JP-A-60-136736.

3. Growth

It is preferred that the pBr during the crystal growth period subsequent to the ripening stage is maintained at 1.4 to 3.5. When the concentration of the protective colloid in the dispersion medium solvent before entering the growth stage is low (1% by weight or less), the protective colloid is additionally added in some cases. In that case, the concentration of the protective colloid in the dispersion medium solvent is preferably from 1% to 10% by weight. The protective colloids used at this time include the above-mentioned alkali-treated gelatin, amino group-modified gelatin, oxidation-treated gelatin, natural polymers and synthetic polymers. When amino group-modified gelatin is present, the pH in the growth stage is preferably from 4 to 8, but in the case of the other gelatin, it is preferably from 2 to 8. The addition speed of $Ag^+$ and halogen ions in the crystal growth period is preferably selected so as to give a crystal growth speed of 20% to 100%, preferably 30% to 100% of the critical crystal growth speed. In this case, the addition speed of the silver ion and the halogen ion is increased with the crystal growth. In that case, the addition speed of the aqueous solutions of the silver salt and the halogen salt may be increased, and the concentration of the aqueous solutions may be increased, as described in JP-B-48-36890 and JP-B-52-16364.

Further, the aqueous solution of the silver salt, the halogen salt solution and optionally the protective colloid solution are added to a mixing vessel provided in addition to a reaction vessel, and mixed by stirring. The resulting fine silver halide grain emulsion is immediately transferred to the reaction vessel, thereby conducting the growth of the silver halide grains in the reaction vessel. In this case, the protective colloid (such as gelatin or the synthetic polymer) may be dissolved in the aqueous solution of the halogen salt. Details of this method are described in JP-A-10-43570.

Tabular silver halide grains whose halogen composition is silver chloride, silver bromide, silver chlorobromide, silver iodobromide, silver chloroiodobromide or silver iodochloride is used in the emulsion preferably used in the present invention. The tabular grain has a (100) or (111) main plane. The tabular grain having the (111) main plane (hereinafter referred to as a (111) tabular grain) usually has a triangle or hexagonal face. In general, a more uniform distribution causes a higher ratio of tabular grains having hexagonal faces. The hexagonal monodisperse tabular grains are described in JP-B-5-61205.

The tabular grain having the (100) face as a main plane (hereinafter referred to as a (100) tabular grain) has a rectangular or square form. In this emulsion, an acicular grain having an adjacent side ratio (a ratio of one side length/another adjacent side length) of less than 5/1 is called the tabular grain. In silver chloride or the tabular grain containing a large amount of silver chloride, the (100) tabular grain is originally high in main plane stability, compared with the (111) tabular grain. In the case of the (111) tabular grain, it is necessary to stabilize the (111) main plane, and this is described in JP-A-9-80660, JP-A-9-80656 and U.S. Pat. No. 5,298,388.

For forming the monodisperse (111) tabular grains, it is useful to use a polymer having repeating units represented by the following formula (1):

$$-(R-O)_n- \quad (1)$$

wherein R represents an alkylene group having 2 to 10 carbon atoms; and n represents the average number of repeating units ranging from 4 to 200.

Further, when the emulsion of the present invention is formed, the polymer having repeating units represented by the following formula (1) is preferably used. However, a vinyl polymer comprising at least one monomer represented by the following formula (2) as a constituent component, or a polyurethane represented by the following formula (3) is preferably used. In particular, the vinyl polymer having repeating units represented by the following formula (2) is preferred.

(2)

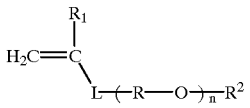

wherein R represents an alkylene group having 2 to 10 carbon atoms; n represents the average number of repeating units ranging from 4 to 200; $R_1$ represents a hydrogen atom or a lower alkyl group; $R^2$ represents a monovalent substituent group; and L represents a divalent linking group.

(3)

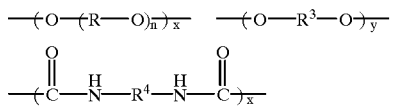

wherein $R^3$ and $R^4$ each represents an alkylene group having 1 to 10 carbon atoms, a phenylene group having 6 to 20 carbon atoms or an aralkylene group having 7 to 20 carbon atoms; n represents the average number of repeating units ranging from 4 to 200; and x, y and z each represents the weight percentage of each component, x is from 1 to 70, y is from 1 to 70 and z is from 20 to 70, wherein x+y+z=100.

Further detailed specific examples and general descriptions are described in European Patents 513,722, 513,723, 513,724, 513,725, 514,742, 514,743 and 518,066 and JP-A-9-54377.

In the preparation of tabular grains having a high aspect ratio, it is particularly useful to use gelatin low in methionine content in the formation of the tabular grains. This is described in JP-B-5-12696. Further, the tabular grains having a higher aspect ratio and a thinner thickness can be obtained by use of amino group-modified gelatin. For specific methods for modifying the amino groups, reference can be made to the descriptions of U.S. Pat. Nos. 2,525,753, 3,118,766, 2,614,928 and 2,614929, JP-B-40-15585, JP-A-8-82883 and *Nippon Shashin Gakkaishi*, Vol. 58, p. 25 (1995).

In the production of the high aspect ratio or extra thin tabular grains used in the present invention, the mixing vessel is provided, in addition to the reaction vessel in which the nucleation stage and/or the growth stage is conducted. It is preferred that the aqueous solution of the water-soluble silver salt and the aqueous solution of the water-soluble halogen salt are supplied to the mixing vessel and mixed with each other to form fine silver halide grains, and that immediately, the fine grains are supplied to the reaction vessel to conduct the nucleation and/or the growth of the silver halide grains in the reaction vessel. This process is described in U.S. Pat. Nos. 4,879,208, 5,035,991, 5,270,159 and 5,380,641, European Patent 507,701 and U.S. Pat. No. 5,250,403.

Figure 2:
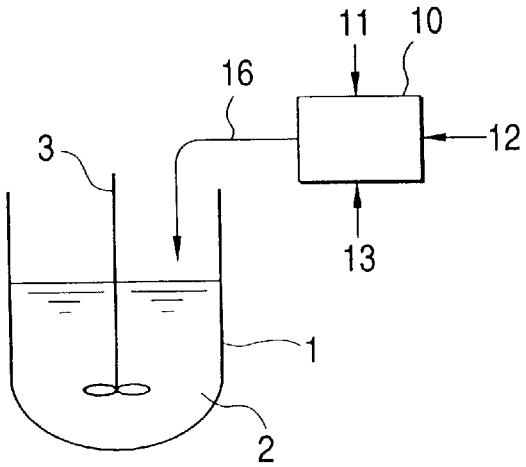
FIG. 2 is a schematic view showing a producing process of a silver halide emulsion used in the present invention.

A system for conducting the above-mentioned nucleation and/or grain growth in the present invention is shown in FIG. 2. Referring to FIG. 2, first, a reaction vessel 1 contains an aqueous solution 2 of a protective colloid. The aqueous solution of the protective colloid is stirred with a stirring blade 3 (a propeller type is shown in this figure) attached to a rotating shaft. An aqueous solution of a silver salt, an aqueous solution of a halide (salt) and optionally the aqueous solution of the protective colloid are supplied through addition systems (supply inlets) 11, 12 and 13 to a mixing vessel 10 provided in addition to the reaction vessel. In this case, the aqueous solution of the protective colloid may be added as a mixture thereof with the aqueous solution of the silver salt and/or the aqueous solution of the halide (salt) as so desired. These solutions are mixed rapidly and vigorously in the mixing vessel, and immediately, introduced into the reaction vessel 1 through a system 16 (a discharge outlet) to conduct the nucleation in the reaction vessel. In this case, the emulsion discharged from the mixing vessel can be once stored in another vessel, followed by addition to the reaction vessel.

After the nucleation is completed in the reaction vessel, the aqueous solution of the silver salt, the aqueous solution of the halide (salt) and optionally the aqueous solution of the protective colloid are further supplied through the addition systems 11, 12 and 13, respectively, to the mixing vessel 10. In this case, the aqueous solution of the protective colloid may be added as a mixture thereof with the aqueous solution of the silver salt and/or the aqueous solution of the halide (salt) as so desired. These solutions are mixed rapidly and vigorously in the mixing vessel, and immediately, continuously introduced into the reaction vessel 1 through the system 16 to conduct the growth of the nuclei already formed in the reaction vessel.

Further, the mixing vessel for formation of fine silver halide grains used in the present invention is described below. For details, reference is made to the description of JP-A-10-43570.

The mixing vessel is a stirring apparatus equipped with a stirring tank provided with a specified number of supply inlets for allowing a water-soluble silver salt and a water-soluble halogen salt to be mixed to flow therein and a discharge outlet for discharging a fine silver halide grain emulsion, and a stirring means for controlling the stirring state of the liquid in the stirring tank by rotation-driving at least one stirring blade in the stirring tank. The term "stirring blade" means a blade which is a pair of blades having a blade at both sides of a central axis of rotation which are symmetrical to the central axis, respectively when a center of the blade is regarded as the central axis of rotation. In the above-mentioned stirring means, mixing by stirring is carried out with two or more stirring blades rotation-driven in the stirring tank, and at least two stirring blades are arranged apart at positions opposite to each other in the stirring tank and rotation-driven in opposite directions to each other (as shown in FIG. 1). Each of the stirring blades constitutes a structure having no shaft penetrating tank walls and forming a magnetic coupling with each of external magnets arranged outside the tank walls close to which each of the stirring blades is disposed, and each external magnet is rotation-driven by each motor arranged outside the tank, thereby rotating each stirring blade. For the stirring blade connected by the magnetic coupling and one of the external magnets, a double face bipolar type magnet is used in which an N polar face and an S polar face are arranged in parallel to a central axis of rotation and so as to overlap across the central axis of rotation, and for the other, a light and left bipolar type magnet is used in which an N polar face and an S polar face are arranged at symmetrical positions to the above-mentioned central axis of rotation on a plane crossing at right angles with the above-mentioned central axis of rotation.

FIG. 1 shows one embodiment of the mixing vessel (stirring apparatus 10) relating to the present invention.

A stirring tank 18 (i.e., a mixing vessel) comprises a main (stirring) tank body 19 whose central axis is directed up and down, and seal plates 20 forming tank walls closing upper and lower opening ends of the main tank body 19. Stirring blades 21 and 22 are arranged apart at upper and lower ends opposite to each other in the stirring tank 18, and rotation-driven in opposite directions to each other. Each of the stirring blades 21 and 22 constitutes a magnetic coupling C with each external magnet 26 arranged outside each of the tank walls close to which each of the stirring blades 21 and 22 is disposed. That is to say, each of the stirring blades 21 and 22 is connected to each of the external magnets 26 by magnetic force, and each of the external magnets 26 is rotation-driven by independent motors 28 and 29, respectively, thereby rotating stirring blades in opposite directions to each other.

The stirring tank 18 has liquid supply inlets 11, 12 and 13 for allowing an aqueous solution of a silver salt, an aqueous solution of a halide (salt) and optionally an aqueous solution of a protective colloid to be mixed to flow therein and a discharge outlet 16 for discharging a fine silver halide grain emulsion after the stirring treatment is completed.

In the present invention, when the stirring blades opposite to each other in the mixing vessel are driven, the number of revolutions thereof is 1000 rpm or more, and preferably 3000 rpm or more. The number of revolutions of the stirring blade rotating to the opposite direction may be the same or different.

In the present invention, in the course of formation of the silver halide grains, at least in the ripening or before the growth, ions other than halogen salts may be added. In this case, the ionic strength in the dispersion medium solutions is preferably from 0.2 to 2.0, and more preferably from 0.3 to 1.0. Further, preferred ionic species are enumerated below, but are not limited thereto.

Examples of ions having positive charge include $H^+$, $Na^+$, $Mg^{2+}$, $Ca^{2+}$, $K^+$, $Ba^{2+}$, $Sr^{2+}$, $Co^{2+}$, $Ni^{2+}$, $Cu^{2+}$, $Zn^{2+}$and $Al^{3+}$, and at least divalent ions are more preferred.

Examples of ions having negative charge include $OH^-$, $NO_3^-$, $SO_4^-$, $ClO_4^-$, $BF_4^-$, $BF_6^-$, $N_3^-$, $CN^-$, $C_2O_4^{2-}$, $SCN^-$, $CO_3^{2-}$ and $COO^-$.

These ions may be supplied as aqueous solutions of inorganic salts. Examples of the inorganic salts include but are not limited to inorganic salts described in *Kagaku Binran, Kiso-hen II*, pages 453 to 455 (Maruzen). The concentration of these aqueous solutions of the inorganic salts may be an appropriate concentration, as long as it is a saturated concentration or less. As another supplying method, the inorganic salts can also be directly added in the powder form. The amount added in this case is an amount so as to give a saturated concentration or less.

Although gelatin is used as the protective colloid, a natural polymer other than gelatin or a synthetic polymer is also similarly used. As the kind of gelatin, alkali-treated gelatin, oxidation-treated gelatin in which methionine groups in the gelatin molecule are oxidized with hydrogen peroxide (the methionine content is 40 $\mu$mol/g or less), amino group-modified gelatin (for example, phthalated gelatin, trimellited gelatin, succinated gelatin, maleated gelatin or esterified gelatin) or low-molecular weight gelatin (molecular weight: 3000 to 40000) is used. Further, natural polymers are described in JP-B-7-111550 and *Research Disclosure*, 176, No. 17643, IX, (December, 1978).

Silver chloride or the (111) tabular grains having a high silver chloride content used in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

The high silver bromide (111) tabular grains used in the present invention are described in U.S. Pat. Nos. 4,425,425, 4,425,426, 4,434,226, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grains used in the present invention are described in U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

In addition to the sensitizing dyes of the present invention, the another sensitizing dyes may be used in combination. Although these sensitizing dyes may be any, preferred examples thereof include cyanine dyes, merocyanine dyes, rhodacyanine dyes, trinuclear merocyanine dyes, allopalar dyes, hemicyanine dyes and styryl dyes. Details of these dyes are described in F. M. Harmer, *Heterocyclic Compounds-Cyanine Dyes and Related Compounds*, John Wiley & Sons, New York, London (1964) and D. M. Sturmer, *Heterocyclic Compounds-Special Topics in Heterocyclic Chemistry*, chapter 18, clause 14, pages 482 to 515.

General formulas of cyanine dyes, merocyanine dyes and rhodacyanine dyes are preferably ones described in U.S. Pat. No. 5,340,694, pages 21 and 22, (XI), (XII) and (XIII).

When the sensitizing dyes used in the invention are added to the silver halide photographic emulsions of the present invention, they may be directly dispersed in the emulsions, or may be dissolved in a single solvent or mixed solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, followed by addition to the emulsions.

Further, methods which can be used also include a method of dissolving a dye in an organic volatile solvent, dispersing the resulting solution in water or a hydrophilic colloid, and then adding the resulting dispersion to an emulsion, as described in U.S. Pat. No. 3,469,987; a method of dispersing a water-insoluble dye in a water-soluble solvent without dissolution, and then adding the resulting dispersion to an emulsion, as described in JP-B-46-24185; a method of dissolving a dye in an acid, and then adding the resulting solution to an emulsion, or allowing an acid or a base to coexist to prepare an aqueous solution, which is added to an emulsion as described in JP-B-44-23389, JP-B-44-27555 and JP-B-57-22091; a method of forming a solution or a colloidal dispersion in the coexistence of an surface active agent, and then adding it to an emulsion, as described in U.S. Pat. Nos. 3,822,135 and 4,006,025; a method of directly dispersing a dye in a hydrophilic colloid, and then adding the resulting dispersion to an emulsion, as described in JP-A-53-102733 and JP-A-58-105141; and a method of dissolving a dye using a red shift-providing compound, and then adding the resulting solution to an emulsion, as described in JP-A-51-74624.

Furthermore, ultrasonics can also be used for dissolution.

The sensitizing dyes used in the present invention may be added to the emulsions at any stage of emulsion preparation which has hitherto been known to be useful. For example, they may be added at the stage of silver halide grain formation and/or prior to desalting, during the desalting stage and/or at any time of from the completion of desalting to the initiation of chemical ripening, as disclosed in U.S. Pat. Nos. 2,735,766, 3,628,960, 4,183,756 and 4,225,666, JP-A-58-184142 and JP-A-60-196749; just before or during chemical ripening as disclosed in JP-A-58-113920, and at any time and stage of before emulsion coating during the period between chemical ripening and coating. Further, as disclosed in U.S. Pat. No. 4,225,666 and JP-A-58-7629, a single compound may be added alone, or combined compounds having foreign kinds of structures may be separately added, for example, during the stage of grain formation and during the stage of chemical ripening or after the completion thereof, or before or during chemical ripening and after the completion thereof. The compounds separately added and combinations thereof may be varied.

The sensitizing dyes used in the present invention can be added in an amount of $1\times10^{-6}$ to $10\times10^{-3}$ mol per mol of silver halide, although the amount added is varied according to the shape and size of silver halide grains. For example, when the size of the silver halide grains ranges from 0.2 to 1.3 $\mu$m, the amount added is preferably from $2\times10^{-6}$ to $8\times10^{-3}$ mol, and more preferably $7.5\times10^{-6}$ to $6\times10^{-3}$ mol, per mol of silver.

The silver halide emulsions are generally subjected to chemical sensitization, and then used. With respect to chemical sensitization, chalcogen sensitization (sulfur sensitization, selenium sensitization or tellurium sensitization), noble metal sensitization (for example, gold sensitization) and reduction sensitization can be conducted alone or in combination.

In sulfur sensitization, labile sulfur compounds are used as sulfur sensitizers. The labile sulfur compounds are described in P. Glafkides, *Chemie et Physique Photographique* (5th ed., Paul Montel, 1987) and *Research Disclosure*, Vol. 307, No. 307105. Examples of the sulfur sensitizers include thiosulfates (for example, hypo), thioureas (for example, diphenylthiourea, triethylthiourea, N-ethyl-N'-(4-methyl-2-thiazolyl)thiourea and carboxymethyltrimethylthiourea), thioamides (for example, thioacetamide), rhodanines (for example, diethylrhodanine and 5-benzylidene-N-ethylrhodanine), phosphine sulfides (for example, trimethylphosphine sulfide), thiohydantoins, 4-oxo-oxazolidine-2-thiones, dipolysulfides (fox example, dimorpholine disulfide, cystine and hexathiocane-thione), mercapto compounds (for example, cystein), polythionates and elementary sulfur. Active gelatin can also be used as the sulfur sensitizer.

In selenium sensitization, labile selenium compounds are used as selenium sensitizers. The labile selenium compounds are described in JP-B-43-13489, JP-B-44-15748, JP-A-4-25832, JP-A-4-109240, JP-A-271341 and JP-A-5-40324. Examples of the selenium sensitizers include colloidal metallic selenium, selenoureas (for example, N,N-dimethylselenourea, trifluoromethylcarbonyl-trimethylselenourea and acetyl-trimethylselenourea), selenoamides (for example, selenoacetamide and N,N-diethylphenylselenoamide), phosphine selenides (for example, triphenylphosphine selenide and pentafluorophenyl-triphenylphosphine selenide), selenophoshpates (for example, tri-p-tolyl selenophosphate and tri-n-butyl selenophosphate), selenoketones (for example, selenobenzophenone), isoselenocyanates, selenocarboxylic acids, selenoesters and diacyl selenides. Relatively stable selenium compounds such as selenious acid, potassium selenocyanate, selenazoles and selenides (described in JP-B-46-4553 and JP-B-52-34492) can also be utilized as the selenium sensitizers.

In tellurium sensitization, labile tellurium compounds are used as tellurium sensitizers. The labile tellurium compounds are described in Canadian Patent 800,958, British Patents 1,295,462 and 1,396,696, JP-A-4-204640, JP-A-4-271341, JP-A-4-333043 and JP-A-5-303157. Examples of the tellurium sensitizers include telluroureas (for example, tetramethyltellurourea, N,N-dimethylethylene-tellurourea and N,N'-diphenylethylenetellurourea), phosphine tellurides (for example, butyl-diisopropylphosphine telluride, tributylphosphine telluride, tributoxyphosphine telluride and ethoxy-diphenylphosphine telluride), diacyl (di)tellurides (for example, bis(diphenylcarbamoyl) ditelluride, bis(N-phenyl-N-methylcarbamoyl) ditelluride, bis(N-phenyl-N-methylcarbamoyl) telluride and bis(ethoxycarbonyl) telluride), isotellurocyanates, telluroamides, tellurohydrazides, telluroesters (butyl hexyl telluroester), telluroketones (telluroacetophenone), colloidal tellurium, (di)tellurides and other tellurium compounds (for example, potassium telluride and sodium telluropentathionate).

In noble metal sensitization, salts of noble metals such as gold, platinum, palladium and iridium are used as sensitizers. The noble metal salts are described in P. Glafkides, *Chemie et Physique Photographique* (5th ed., Paul Montel, 1987) and *Research Disclosure*, Vol. 307, No. 307105. Gold sensitization is particularly preferred. As described above, the present invention is particularly effective in an embodiment in which gold sensitization is carried out. *Photographic Science and Engineering*, vol. 19322 (1975) and *Journal of Imaging Science*, vol. 3228 (1988) describes that gold can be removed from sensitized nuclei on emulsion grains with a solution containing potassium cyanide (KCN). According to these descriptions, a cyanide ion makes a gold atom or a gold ion adsorbed onto a silver halide grain isolate as a cyanate complex to hinder gold sensitization according to the present invention. If the generation of cyanogen is inhibited, the function of gold sensitization can be sufficiently obtained.

Examples of the gold sensitizers include chloroauric acid, potassium chloroaurate, potassium aurithiocyanate, gold sulfide, and gold selenide. Further, gold compounds described in U.S. Pat. Nos. 2,642,361, 5,049,484 and 5,049,485 can also be used.

In reduction sensitization, reducing compounds are used as sensitizers. The reducing compounds are described in P. Glafkides, *Chemie et Physique Photographique* (5th ed., Paul Montel, 1987) and *Research Disclosure*, Vol. 307, No. 307105. Examples of the reduction sensitizers include aminoiminomethanesulfinic acids (thiourea dioxide), borane compounds (for example, dimethylamine borane), hydrazine compounds (for example, hydrazine and p-tolylhydrazine), polyamine compounds (for example, diethylenediamine and triethylenetetramine), stannous chloride, silane compounds, reductions (for example, ascorbic acid), sulfites, aldehyde compounds and hydrogen gas. Further, reduction sensitization can also be conducted in an atmosphere of high pH or excessive silver ions (so-called silver ripening).

Chemical sensitization may be conducted as a combination of two or more kinds of sensitizations. The combination of chalcogen sensitization and gold sensitization is particularly preferred. Further, reduction sensitization is preferably performed during formation of the silver halide grains. The amount of the sensitizers used is generally determined depending on the kind of silver halide grain and the conditions of chemical sensitization.

The amount of the chalcogen sensitizers used is generally from $10^{-8}$ mol to $10^{-2}$ mol, and preferably from $10^{-7}$ mol to $5\times10^{-3}$ mol, per mol of silver halide.

The amount of the noble metal sensitizers used is preferably from $10^{-7}$ mol to $10^{-2}$ mol per mol of silver halide.

There is no particular limitation on the conditions of chemical sensitization. The pAg is generally from 6 to 11, and preferably from 7 to 10. The pH is preferably from 4 to 10. The temperature is preferably from 40° C. to 95° C., and more preferably from 45° C. to 85° C.

The silver halide emulsions may contain various compounds in order to prevent fogging during manufacturing stages, storage or photographic processing of the photographic materials or to stabilize photographic properties thereof. Examples of such compounds include azoles (for example, benzothiazolium salts, nitroindazoles, triazoles, benzotriazoles and benzimidazoles (particularly, nitro- or halogen-substituted compounds); heterocyclic mercapto compounds (for example, mercaptothiazoles, mercaptobenzo-thiazoles, mercaptobenzimidazoles, mercaptothiadiazoles, mercaptotetrazoles (particularly, 1-phenyl-5-mercapto-tetrazole) and mercaptopyrimidines; the above-mentioned heterocyclic mercapto compounds having a water-soluble group such as carboxyl groups or sulfone groups; thioketo compounds (for example, oxazolinethione); azaindenes (for example, tetraazaindenes (particularly, 4-hydroxysubstituted (1,3,3a,7)-tetraazaindenes)); and benzenethiosulfonic acids and benzenesulfinic acids. Generally, these compounds are known as antifoggants or stabilizers.

The antifoggants and the stabilizers are usually added after application of chemical sensitization. However, they can be added at a time selected from the period in the course of chemical sensitization or before the initiation of chemical sensitization. That is to say, they may be added during addition of the silver salt solutions, from after the addition to the initiation of chemical sensitization, or in the course of chemical sensitization (within a time preferably up to 50%, more preferably up to 20%, from the initiation during chemical sensitization) in the course of formation of the silver halide emulsion grains.

Various color couplers can be used in the present invention. Although specific examples thereof are described in the patents cited in *Research Disclosure*, No. 17643, VII-C to G and ibid. No. 307105, VII-C to G described above, non-diffusible couplers having hydrophobic groups called "ballast groups" or polymerized couplers are preferably used. The couplers may be either 4 equivalents or 2 equivalents based on silver ion. Colored couplers having the effect of color correction or couplers releasing development inhibitors with the progress of development (so-called DIR couplers) may be contained. Further, non-coloring DIR coupling compounds providing colorless products by coupling reactions and releasing development inhibitors may be contained.

In the couplers preferably used in the present invention, examples of cyan couplers include naphthol couplers and phenol couplers. Preferred examples thereof are described in U.S. Pat. Nos. 2,369,929, 2,772,162, 2,801,171, 2,895,826, 3,446,622, 3,758,308, 3,772,002, 4,052,212, 4,126,396, 4,146,396, 4,228,233, 4,254,212, 4,296,199, 4,296,200, 4,327,173, 4,333,999, 4,334,011, 4,343,011, 4,427,767, 4,451,559, 4,690,889 and 4,775,616, West German Patent (OLS) 3,329,729, EP-A-121365, EP-A-249453 and JP-A-61-42658.

In the magenta couplers of the present invention, imidazo[1,2-b]pyrazoles described in U.S. Pat. No. 4,500,630 and pyrazolo[1,5-b][1,2,4]triazoles described in U.S. Pat. No. 4,540,654 are preferred. In addition, A pyrazolotriazole coupler having a branched alkyl group directly connected to the 2-, 3- or 6-position of a pyrazolotriazole ring as described in JP-A-61-65245, a pyrazoloazole coupler containing a sulfonamido group in its molecule as described in JP-A-61-65246, a pyrazoloazole coupler having an alkoxyphenylsulfonamido ballast group as described in JP-A-61-147254, and a pyrazolotriazole coupler having an alkoxy group or an aryloxy group at the 6-position thereof as described in EP-A-226849 and EP-A-294785 are preferably used. Besides, couplers described in U.S. Pat. Nos. 3,061,432, 3,725,067, 4,310,619, 4,351,897 and 4,556,630, European Patent 73,636, JP-A-55-118034, JP-A-60-35730, JP-A-60-43659, JP-A-60-185951, JP-A-61-72238, PCT International Publication No. WO88/04795, and the patents cited in *Research Disclosure*, No. 24220 and ibid. No. 24230 are also preferred.

Preferred examples of yellow couplers are described in U.S. Pat. Nos. 3,933,501, 3,973,968, 4,022,620, 4,248,961, 4,314,023, 4,326,024, 4,401,752 and 4,511,649, EP-A-249473, JP-B-58-10739, British Patents 1,425,020 and 1,476,760, and pivaloylacetanilides are more preferred.

The above-mentioned couplers which can be preferably used in the present invention are couplers similar to those described as preferred couplers in detail in JP-A-2-248945, and concrete examples of the above preferred couplers include the same compounds as concrete examples of couplers described in JP-A-2-248945, pages 22 to 29.

Typical examples of dye-forming polymer couplers are described in U.S. Pat. Nos. 3,451,820, 4,080,211, 4,367,282, 4,409,320 and 4,576,910, EP-A-341188 and British Patent 2,102,137, and the use thereof is more preferred.

Preferred examples of couplers whose color-forming dyes have appropriate diffusibility include those described in U.S. Pat. No. 4,366,237, European Patent 96,570, British Patent 2,125,570 and West German Patent (OLS) 3,234,533.

Preferred colored couplers for correcting unnecessary absorption of color-forming dyes are described in *Research Disclosure*, No. 17643, Item VII-G, ibid. 307105, Item VII-G, U.S. Pat. Nos. 4,004,929, 4,138,258 and 4,163,670, British Patent 1,146,368 and JP-B-57-39413. It is also preferred to use couplers for correcting unnecessary absorption of color-forming dyes with fluorescent dyes released on coupling, and to use couplers having dye precursor groups as releasing groups which can react with developing agents for forming dyes. The former couplers are described in U.S. Pat. No. 4,774,181 and the latter couplers are described in U.S. Pat. No. 4,777,120.

Couplers which release photographically useful residues on coupling can also be preferably used in the present invention. Preferred DIR couplers which release development inhibitor are described in the patents cited in *Research Disclosure*, No. 17643, Item VII-F and ibid., No. 307105, Item VII-F described above, JP-A-57-151944, JP-A-57-

154234, JP-A-60-184248, JP-A-63-37346, JP-A-63-37350 and U.S. Pat. Nos. 4,248,962 and 4,782,012.

Preferred couplers which imagewise release nucleating agents or development accelerators on development are described in JP-A-59-157638, JP-A-59-170840, British Patents 2,097,140 and 2,131,188. Further, preferred couplers which release fogging agents, development accelerators, solvents for silver halides and the like by oxidation-reduction reaction with oxidation products of developing agents are described in JP-A-60-107029, JP-A-60-252340, JP-A-1-44940 and JP-A-1-45687.

Other compounds which can be used in the photographic materials of the present invention include competitive couplers described in U.S. Pat. No. 4,130,427, multi equivalent couplers described in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described in JP-A-60-185950 and JP-A-62-24252, couplers which release dyes recoloring after releasing described in EP-A-173302 and EP-A-313308, bleach accelerator releasing couplers described in the patents cited in Research Disclosure, No. 11449 and ibid., No. 24241 and JP-A-61-201247, ligand releasing couplers described in U.S. Pat. No. 4,553,477, leuco dye releasing couplers described in JP-A-63-75747 and fluorescent dye releasing couplers described in U.S. Pat. No. 4,774,181.

For satisfying the characteristics required for the photographic materials, two or more of the above-mentioned couplers can be used in combination in the same layer, or the same coupler may be of course safely added to two or more different layers.

The above-mentioned couplers are contained in silver halide photographic emulsion layers constituting light-sensitive layers, usually in an amount of 0.1 mol to 1.0 mol, preferably in an amount of 0.1 mol to 0.5 mol, per mol of silver.

In the present invention, for adding the above-mentioned couplers to light-sensitive layers, known various processes can be applied. Usually, the couplers can be added by the oil-in-water dispersion methods known as the oil protect methods. After dissolution in solvents, the couplers are dispersed by emulsification in aqueous solutions of gelatin containing surfactants. Alternatively, water or aqueous solutions of gelatin may be added to surfactant-containing coupler solutions to form oil-in-water dispersions with phase inversion. Further, the alkali-soluble couplers can also be dispersed by the so-called Fischer dispersion method. After low boiling point organic solvents are removed from the coupler dispersions by distillation, water washing with noodle or ultrafiltration, the couplers may be mixed with photographic emulsions.

As dispersion media for such couplers, high boiling point organic solvents and/or water-insoluble polymers having a dielectric constant of 2 to 20 (25° C.) and a refractive index of 1.5 to 1.7 (25° C.) are preferably used. Although solvents as described in JP-A-2-248945 mentioned above, page 30, are used as the preferred high boiling point organic solvents, any solvents can be used, as long as they are water-immiscible compounds having a melting point of 100° C. or less and a boiling point of 140° C. or more, and good solvents for the couplers. The melting point of the high boiling point organic solvents is preferably 80° C. or less, and the boiling point thereof is preferably 160° C. or more and more preferably 170° C. or more.

Details of these high boiling organic solvents are described in JP-A-62-215272, page 137, lower right column to page 144, upper right column.

These couplers can be impregnated in loadable latex polymers (for example, U.S. Pat. No. 4,203,716) in the presence or absence of the above-mentioned high boiling point organic solvents, or dissolved in water-insoluble and organic solvent-soluble polymers, followed by dispersion and emulsification in aqueous solutions of hydrophilic colloids. Preferably, homopolymers or copolymers described in PCT International Publication No. W088/00723, pages 12 to 30, are used, and particularly, the use of acrylamide polymers is preferred in view of color image stability.

Further, it is preferred that the following compounds are used together with the above-mentioned couplers.

That is to say, it is preferred that compounds which chemically combine with aromatic amine developing agents remaining after color development to form chemically inactive, substantially colorless compounds, and/or compounds which combine with oxidized products of aromatic amine color developing agents remaining after color development to form chemically inactive, substantially colorless compounds are used simultaneously or independently, in view of prevention of side actions such as generation of stains caused by formation of color-forming dyes by the reaction of the color developing agents or oxidized products thereof remaining in the layers with the couplers during storage after processing. Such compounds and preferred conditions thereof are described in JP-A-2-248945, pages 31 and 32 in detail. Preferred specific examples of the former compounds include compounds described in JP-A-63-158545, JP-A-62-283338, JP-A-64-2042, EP-A-277589 and EP-A-298321, and preferred specific examples of the latter compounds include compounds described in JP-A-62-143048, JP-A-62-229145, EP-A-255722, JP-A-64-2042, JP-A-1-57259, JP-A-1-230039, EP-A-277589 and EP-A-298321. Further, details of combinations of the above-mentioned former compounds and latter compounds are described in EP-A-277589.

For more enhancing image sharpness and safe light-safety or preventing color mixing, dyes may be used in silver halide emulsion layers and/or other hydrophilic colloidal layers of the silver halide photographic materials containing the emulsions according to the present invention. The dyes may be fixed to layers either containing or not containing the above-mentioned emulsions. However, they are preferably fixed to specified layers. For that purpose, the dyes are added to the colloidal layers in an anti-diffusible state, and used so as to be able to be decolorized in the course of development processing. First, fine grain dispersions of dyes substantially insoluble in water at pH 7 and becoming soluble in water at a pH of higher than 7 are used. Second, acid dyes are used together with polymers or polymer latexes providing cation sites. In the first and second methods, dyes represented by formulas (VI) and (VII) described in JP-A-63-197947 are useful. In particular, in the first method, dyes having carboxyl groups are useful.

It is preferred that the photographic materials of the present invention contain various preservatives or antifungal agents such as 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole described in JP-A-62-272248, JP-A-63-257747 and JP-A-1-80941 and phenetyl alcohol.

There is no particular limitation on other additives for the photographic materials of the present invention, and reference can be made to the descriptions of *Research Disclosure*, 176, item 17643 (RD 17643), ibid., 187, item 18716 (RD 18716) and ibid., item 308119 (RD 308119).

Portions in which various additives are described in RD 17643, RD 18716 and RD 308119 are summarized in the following.

| Type of Additives | RD17643 | RD18716 | RD308119 |
|---|---|---|---|
| 1. Chemical Sensitizers | p. 23 | p. 648, right col. | p. 996 |
| 2. Sensitivity Increasing Agents | | ditto | |
| 3. Spectral Sensitizers, Supersensitizers | p. 23–24 | p. 648, right col.–p. 649, right col. | p. 996, right col.–p. 998, right col. |
| 4. Brightening Agents | p. 24 | | p. 998, right col. |
| 5. Antifoggants, Stabilizers | p. 24–25 | p. 649, right col. | p. 998, right col.–p. 1000, right col. |
| 6. Light Absorbers, Filter dyes, UV Absorbers | p. 25–26 | p. 648, right col.–p. 650, left col. | p. 1003, left col.–p. 1003, right col. |
| 7. Stain Inhibitors | p. 25, right col. | p. 650, left col.–right col. | p. 1002, right col. |
| 8. Dye Image Stabilizers | p. 25 | | p. 1002, right col. |
| 9. Hardeners | p. 26 | p. 651, left col. | p. 1004, right col.–p. 1005, left col. |
| 10. Binders | p. 26 | ditto | p. 1003, right col.–p. 1004, right col. |
| 11. Plasticizers, Lubricants | p. 27 | p. 650, right col. | p. 1006, left col.–p. 1006, right col. |
| 12. Coating Aids, Surfactants | p. 26–27 | ditto | p. 1005, left col.–p. 1006, left col. |
| 13. Antistatic Agents | p. 27 | ditto | p. 1006, right col.–p. 1007, left col. |
| 14. Matte Agents | | | p. 1008, left col.–p. 1009, left col. |

The present invention can be applied to, for example, taking black-and-white and color negative films (for general use or cinematographic use), color reversal films (for slide use or cinematographic use), black-and-white and color photographic printing paper, color positive films (cinematographic use), color reversal photographic printing paper, heat developable black-and-white and color light-sensitive materials, plate-making black-and-white and color photographic materials (such as lith films and scanner films), medical and industrial black-and-white and color light-sensitive materials, and black-and-white and color diffusion transfer light-sensitive materials (DTR). In particular, the photographic materials can be preferably used for the color papers.

Appropriate supports which can be used in the present invention are described in, for example, *Research Disclosure*, No. 17643, page 28, ibid., No. 18716, page 647, right column to page 648, left column, and ibid., No. 307105, page 879.

For photographic processing of the light-sensitive materials produced by the present invention, any known methods can be used, and known processing solutions can be used. The processing temperature is usually selected between 18° C. and 50° C., but it may be lower than 18° C. or higher than 50° C. Both development processing for forming silver images (black-and-white photographic processing) and color photographic processing comprising development processing for forming dye images are applicable according to their purpose.

In black-and-white developing solutions, known developing agents such as dihydroxybenzenes (for example, hydroquinone), 3-pyrazolidones (for example, 1-phenyl-3-pyrazolidone) and aminophenols (for example, N-methyl-p-aminophenol) can be used alone or in combination.

Color developing solutions are generally aqueous alkaline solution containing color developing agents. As the color developing agents, known aromatic primary amine developing agents can be used, and examples thereof include phenylenediamines (for example, 4-amino-N-diethylaniline, 4-amino-3-methyl-N,N-diethylaniline, 4-amino-N-ethyl-N-β-hydroxyethylaniline, 4-amino-3-methyl-N-ethyl-N-β-hydroxyethylaniline, 4-amino-3-methyl-N-ethyl-N-β-methanesulfoamidoethylaniline and 4-amino-3-methyl-N-ethyl-N-β-methoxyethylaniline).

Besides these, developing agents described in L. F. A. Maison, *Photographic Processing Chemistry*, Focal Press, pages 226 to 229 (1966), U.S. Patents 2,193,015 and 2,592,364, JP-A-48-64933 may also be used. In addition, the developing solutions can contain pH buffers such as alkali metal sulfites, carbonates, borates and phosphates, and developing inhibitors or antifoggants such as bromides, iodides and organic antifoggants. Further, they may contain hard-water softeners, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium boron hydride, auxiliary developing agents such as 1-phenyl-3-pyrazolidone, tackifiers, polycarboxylic acid chelating agents described in U.S. Pat. No. 4,083,723 and antioxidants described in German Patent Publication (OLS) No. 2,622,950, as required.

When subjected to color photographic processing, the photographic materials are generally bleached after color development. Bleaching may be carried out simultaneously with fixing or separately. As bleaching agents, for example, compounds of polyvalent metals such as iron (III), cobalt (III), chromium (IV) and copper (II), peracids, quinones and nitroso compounds are used. Examples of the bleaching agents include ferricyanides; bichromates; organic complex salts of iron (III) or cobalt (III), for example, complex salts of aminopolycarboxylic acids such as ethylenediaminetetraacetic acid, nitrilotriacetic acid and 1,3-diamino-2-propanoltetra-acetic acid, or complex salts of organic acids such as citric acid, tartaric acid and maleic acid; persulfates; permanganates; and nitrosophenol. Of these, potassium ferricyanide, sodium ethylenediaminetetraacetato iron (III) and ammonium ethylenediaminetetraacetato iron (III) are particularly useful. The complex salts of ethylenediaminetetraacetato iron (III) are also useful for both independent bleaching solutions and combined bleaching-fixing solutions.

The bleaching or bleaching-fixing solutions may also contain various additives, in addition to thiol compounds described in U.S. Pat. Nos. 3,042,520 and 3,241,966, JP-B-45-8506, JP-B-45-8836. After bleaching or bleaching-fixing, the photographic materials may be subjected to washing, or may only be subjected to stabilizing processing.

The present invention can be preferably applied to silver halide photographic materials having transparent magnetic recording layers. The silver halide photographic materials carrying the transparent magnetic recording layers used in the present invention may be previously heat-treated thin layer polyester supports described in JP-A-6-35118, JP-A-6-17528 and JIII Journal of Technical Disclosure No. 94-6023 in detail (for example, polyethyene aromatic dicarboxylate polyester supports having a thickness of 50 μm to 300 μm, preferably 50 μm to 200 μm, more preferably 80 μm to 115 μm, particularly preferably 5 μm to 105 μm, heat-treated (i.e., subjected to annealing) at a temperature of the glass transition temperature or less for 1 hour to 1500 hours, subjected to surface treatment such as ultraviolet irradiation described in JP-B-43-2603, JP-B-43-2604 and JP-B-45-3828, corona discharge described in JP-B-48-5043 and JP-A-51-131576 or glow discharge described in JP-B-35-7578 and JP-B-46-43480, provided with undercoat layers described in U.S. Pat. No. 5,326,689, optionally, provided subbing layers described in U.S. Pat. No. 2,761,791, and applied with ferromagnetic particles described in JP-A-59-23505, JP-A-4-195726 and JP-A-6-59357).

The above-mentioned magnetic layers may be formed in a stripe form as described in JP-A-4-124642 and JP-A-124645.

Further, antistatic treatment described in JP-A-4-62543 is applied thereto, if necessary, and finally, silver halide photographic emulsions are applied. The silver halide photographic emulsions used herein are ones described in JP-A-4-166932, JP-A-3-41436 and JP-A-3-41437.

The photographic materials thus produced are preferably produced by a production control method described in JP-B-4-86817, and the production data are preferably recorded by a method described in JP-B-6-87146. Before or after that, the photographic materials are cut to films having a narrower width than the conventional 135 size films according to a method described in JP-A-4-125560, and two perforations are formed on one side per small format image so as to match with a smaller format image than the conventional one.

The films thus produced are put in cartridge packages described in JP-A-4-157459, cartridges described in FIG. 9 of JP-A-5-210202, film cassettes described in U.S. Pat. No. 4,221,479 or cartridges described in U.S. Pat. Nos. 4,834,306, 4,834,366, 5,226,613 and 4,846,418 for use.

As the film cartridges or film cassettes used herein, ones of the film tongue-containable type are preferred from the viewpoint of light-shielding property.

Further, cartridges having locking mechanisms as described in U.S. Pat. No. 5,296,886, cartridges in which the use state is indicated as described in U.S. Pat. No. 5,347,334 and cartridges having mechanisms for preventing double exposure are preferred.

Furthermore, cartridges may be used in which only insertion of films into the cartridges results in easy loading of the films, as described in JP-A-6-85128.

The film cartridges thus produced can be used for photographing, development and various enjoying manners depending on their purpose, using cameras, developing apparatuses and laboratory equipment.

For example, the use of easy loading type cameras described in JP-A-6-8886 and JP-A-6-99908, automatic winding type cameras described in 6-57398 and 6-101135, cameras described in JP-A-6-205690 of which films can be taken out to exchange them to other kinds of films in the course of photographing, cameras described in JP-A-5-293138 and JP-A-5-283382 in which information in photographing such as panoramic photography, Hi-Vision photography and normal photography (magnetic recording which can select the print aspect ratio is possible) can be magnetically recorded, cameras having a function of preventing double exposure described in JP-A-6-101194 and cameras having a function of indicating the use state of films described in JP-A-5-150577 allows to fully exhibit the functions of the film cartridges (cassette).

The films thus exposed are processed with automatic processors described in JP-A-6-222514 and JP-A-6-212545, or before, during or after processing, methods for utilizing magnetic records on films described in JP-A-6-95265 and JP-A-4-123054 may be used, or a function of selecting the aspect ratio described in JP-A-5-19364 may be utilized.

In the case of cinematic type development in processing, the films are processed by splicing them by a method described JP-A-5-119461.

Further, in development processing or after that, the films are subjected to attach-detach treatment described in JP-A-6-14880.

After such treatment, the film information may be converted to prints through back prints to color paper and front prints by methods described in JP-A-2-184835, JP-A-4-186335 and JP-A-6-79968.

Further, the films may be returned to customers together with index prints and return cartridges described in JP-A-5-11353 and JP-A-5-232594.

The present invention will be further illustrated in greater detail with reference to the following examples, which are, however, not to be construed as limiting the invention.

EXAMPLE 1

Emulsion 1-A (Extra Thin Tabular Silver Iodobromide Grain Emulsion)

In the system shown in FIG. 2, using the mixing vessel (having an internal volume of 2 cc) shown in FIG. 1, tabular grains were prepared in the following manner.

To the reaction vessel 1, 1.0 liter of water and 2 g of low molecular weight ossein gelatin (average molecular weight: 10,000) were added, and the resulting solution was kept at 35° C. To the mixing vessel 7, 50 ml of a 0.6 M aqueous solution of silver nitrate and 200 ml of a 0.16 M aqueous solution of KBr containing 0.8% by weight of low molecular weight gelatin were added for 2 minutes, and the resulting emulsion was continuously added to the reaction vessel for 2 minutes. At that time, the number of stirring revolutions of the mixing vessel was 2000 rpm (nucleation).

Then, 300 ml of a 10% solution of ossein gelatin subjected to oxidation treatment (methionine content: 5 μmol/g) and KBr were added to adjust the pBr of the emulsion in the reaction vessel to 2.1, followed by elevation of the temperature to 85° C. (ripening).

Thereafter, 600 ml of a 1.0 M aqueous solution of silver nitrate, 600 ml of a 0.98 M solution of KBr containing 3 mol % of KI and 800 ml of a 5% aqueous solution of low molecular weight gelatin were added again to the mixing vessel at an accelerated flow rate (the flow rate at the time when addition was completed was 4 times the initial flow rate). Fine grains produced in the mixing vessel were continuously added to the reaction vessel. At that time, the number of stirring revolutions of the mixing vessel was 2000 rpm.

During the growth of grains, at the time when 70% of silver nitrate was added, $IrCl_6$ was added in an amount of $8\times10^{-8}$ mol/mol-Ag to dope the grains therewith. Further, before the growth of grains was completed, a yellow prussiate solution was added to the mixing vessel. Three percent (in terms of the amount of silver added) of shell portions of the grains were doped with yellow prussiate so as to give a local concentration of $3\times10^{-4}$ mol/mol-Ag. After the addition was terminated, the emulsion was cooled to 35° C., and washed with water by ordinary flocculation. Then, 70 g of lime-treated ossein gelatin was added and dissolved to adjust the pAg to 8.7 and the pH to 6.5, followed by storage thereof in a cool and dark location.

The resulting tabular grains were extra thin monodisperse tabular grains having an equivalent-circle diameter of 2.3 μm, a mean thickness of 0.045 μm, a mean aspect ratio of 51 and a variation coefficient in an equivalent-circle diameter of 16%. The term "equivalent-circle diameter" as used herein means the diameter of a circle at the time when a projected area of a tabular grain is converted to the circle, and the term "variation coefficient" means (standard deviation of equivalent-circle diameter/mean equivalent-circle diameter)×100.

Further, the term "mean aspect ratio" means the mean value of the aspect ratios (equivalent-circle diameters of grains/thickness of grains) of all tabular grains in an emulsion.

Emulsion 1-Bm (Tabular Silver Iodobromide Grain Emulsion)

To the reaction vessel 1, 1.0 liter of water, 3 g of low molecular weight ossein gelatin (average molecular weight: 20,000) and 0.5 g of KBr were added, and the resulting solution was kept at 40° C. Then, 10 ml of a 0.5 M silver nitrate solution and 20 ml of a 0.3 M KBr solution were added thereto with stirring for 40 seconds, followed by addition of 22 ml of a 0.8 M KBr solution. Thereafter, the temperature was elevated to 75° C., and ripening was conducted for 5 minutes. Then, 300 ml of a 10 wt % aqueous solution of ossein gelatin was added, and 800 ml of a 1.5 M silver nitrate solution and 800 ml of a 1.5 M KBr solution containing 3 mol % of KI were each added for 60 minutes. At that time, the temperature of the reaction vessel was kept at 75° C.

During the growth of grains, at the time when 70% of silver nitrate was added, $IrCl_6$ was added in an amount of $8\times10^{-8}$ mol/mol-Ag to dope the grains therewith. Further, before the growth of grains was completed, a yellow prussiate solution was added to the mixing vessel. Three percent (in terms of the amount of silver added) of shell portions of the grains were doped with yellow prussiate so as to give a local concentration of $3\times10^{-4}$ mol/mol-Ag. After the addition was terminated, the emulsion was cooled to 35° C., and washed with water by ordinary flocculation. Then, 70 g of lime-treated ossein gelatin was added and dissolved to adjust the pAg to 8.7 and the pH to 6.5, followed by storage thereof in a cool and dark location.

The resulting tabular grains were monodisperse tabular grains having an equivalent-circle diameter of 1.1 μm, a mean thickness of 0.19 μm, a mean aspect ratio of 6 and a variation coefficient in an equivalent-circle diameter of 15%.

The volume of the tabular grain of emulsion 1-A was almost same as that of emulsion 1-B, and the surface area per grain of emulsion 1-A was about 3.2 times that of Emulsion 1-B.

Each compound shown in Table 1 was added to the two emulsions in an amount shown in Table 1, followed by stirring at 40° C. for 10 minutes. Then, the temperature was elevated to 60° C., and sodium thiosulfate, potassium chloroaurate and potassium thiocyanate were added to conduct optimum chemical sensitization.

TABLE 1

| | | Sensitizing Dye | | | | |
|---|---|---|---|---|---|---|
| Sample No. | Emulsion | Compound No. | Amount Added (mol/mol-Ag) | Sensitivity | Residual Color | Remark |
| 101 | 1-B | SS-1 | $9\times10^{-4}$ | 100 (Standard) | x | Comparison |
| 102 | " | (30) | " | 110 | Δ | Invention |
| 103 | " | (29) | " | 112 | Δ | Invention |
| 104 | " | (24) | " | 114 | Δ | Invention |
| 105 | " | (23) | " | 115 | ○ | Invention |
| 106 | " | (22) | " | 116 | ○ | Invention |
| 107 | " | (21) | " | 118 | ○ | Invention |
| 108 | " | (20) | " | 121 | ○ | Invention |
| 109 | " | (19) | " | 125 | ◎ | Invention |
| 110 | " | SS-2 | " | 91 | x | Comparison |
| 111 | " | (6) | " | 101 | Δ | Invention |
| 112 | " | (5) | " | 103 | ○ | Invention |
| 113 | " | (4) | " | 105 | ○ | Invention |
| 114 | " | (3) | " | 106 | ○ | Invention |
| 115 | " | (2) | " | 109 | ◎ | Invention |
| 116 | " | (1) | " | 111 | ◎ | Invention |
| 117 | 1-A | SS-1 | $3\times10^{-3}$ | 161 | x | Comparison |
| 118 | " | (30) | " | 201 | Δ | Invention |
| 119 | 1-A | (29) | $3\times10^{-3}$ | 213 | Δ | Invention |
| 120 | " | (24) | " | 214 | Δ | Invention |
| 121 | " | (23) | " | 216 | ○ | Invention |
| 122 | " | (22) | " | 218 | ○ | Invention |
| 123 | " | (21) | " | 220 | ○ | Invention |
| 124 | " | (20) | " | 221 | ◎ | Invention |
| 125 | " | (19) | " | 225 | ◎ | Invention |
| 126 | " | SS-2 | " | 150 | x | Comparison |
| 127 | " | (6) | " | 183 | Δ | Invention |
| 128 | " | (5) | " | 184 | ○ | Invention |
| 129 | " | (4) | " | 187 | ○ | Invention |
| 130 | " | (3) | " | 191 | ○ | Invention |
| 131 | " | (2) | " | 193 | ◎ | Invention |
| 132 | " | (1) | " | 197 | ◎ | Invention |

SS-1

TABLE 1-continued

| Sample No. | Emulsion | Sensitizing Dye: Compound No. | Sensitizing Dye: Amount Added (mol/mol-Ag) | Sensitivity | Residual Color | Remark |
|---|---|---|---|---|---|---|

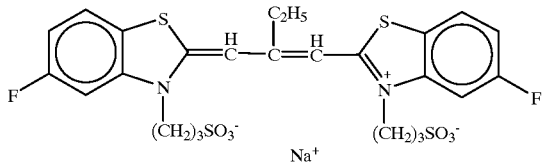

SS-2

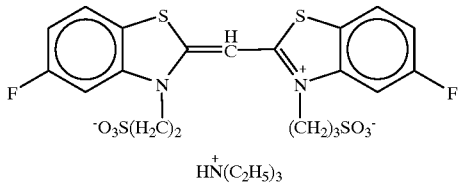

Triacetyl cellulose film supports having underlayers were coated with emulsion layers and protective layers under the following conditions to prepare coated samples.

(1) Emulsion Layer

Emulsion: various emulsions (silver: $3.6\times10^{-2}$ mol/m$^2$)

Coupler shown below ($1.5\times10^{-3}$ mol/m$^2$)

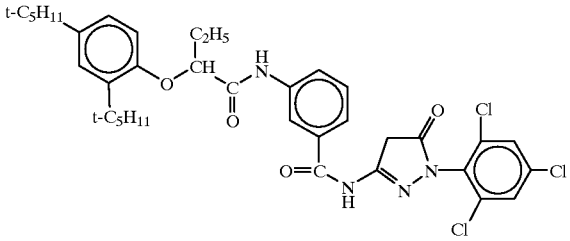

Tricresyl Phosphate (1.10 g/m$^2$)

Gelatin (2.30 g/m$^2$)

(2) Protective Layer

Sodium Salt of 2,4-Dichloro-6-hydroxy-s-triazine (0.08 g/m$^2$)

Gelatin (1.80 g/m$^2$)

These samples were allowed to stand under the conditions of 40° C. and 70% RH for 14 hours, and then, subjected to exposure through a green filter and a continuous wedge for 1/100 second, followed by the following color development.

[Color Development]

| Processing Stage | Processing Time | Temperature |
|---|---|---|
| Color Development | 2 minutes | 40° C. |
| Bleach-Fixing | 3 minutes | 40° C. |
| Rinsing (1) | 20 seconds | 35° C. |
| Rinsing (2) | 20 seconds | 35° C. |
| Stabilization | 20 seconds | 35° C. |
| Drying | 50 seconds | 65° C. |

The compositions of processing solutions are shown below:

| | (unit: g) |
|---|---|
| (Color Development) | |
| Diethylenetriaminepentaacetic Acid | 2.0 |
| Sodium 1-Hydroxyethylidene-1,1-disulfonic Sulfite | 4.0 |
| Potassium Carbonate | 30.0 |
| Potassium Bromide | 1.4 |
| Potassium Iodide | 1.5 mg |
| Hydroxyaminesulfuric Acid | 2.4 |
| 4-[N-Ethyl-N-(β-hydroxyethyl)amino]-2-methylaniline Sulfate | 4.5 |
| Water to make | 1.0 liter |
| pH | 10.05 |
| (Bleach-Fixing Solution) | |
| Ammonium Ethylenediaminetetra-acetato Ferrate Dihydrate | 90.0 |
| Disodium Ethylenediaminetetraacetate | 5.0 |
| Sodium Sulfite | 12.0 |
| Aqueous Ammonium Thiosulfate (70%) | 260.0 ml |
| Acetic Acid (98%) | 5.0 ml |
| Bleaching Accelerator shown below | 0.01 mol |

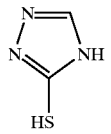

| | |
|---|---|
| Water to make | 1.0 liter |
| pH | 6.0 |
| (Rinsing Solution) | |

City water was passed through a mixed bed column filled with an H-type cation exchange resin (Amberlite IR-120B manufactured by Rohm & Haas Co.) and an OH-type anion exchange resin (Amberlite IR-400 manufactured by Rohm & Haas Co.) to reduce the ion concentrations of calcium and magnesium to 3 mg/liter or less, and subsequently, 20 mg/liter of sodium isocyanurate dichloride and 1.5 g/liter of sodium sulfate were added thereto.

The pH of this solution was within the range of 6.5 to 7.5.

| (Stabilizing Solution) | (unit: mg) |
|---|---|
| Formalin (37%) | 2.0 ml |
| Polyoxyethylene-p-monononyl Phenyl Ether (average deqree of polymerization: 10) | 0.3 |
| Disodium Ethylenediaminetetraacetate | 0.05 |
| Water to make | 1.0 liter |
| pH | 5.0–8.0 |

For the developed films, the optical density was measured with a Fuji automatic densitometer. The fog was taken as the density of unexposed areas, and the sensitivity was indicated as the relative value of the reciprocal of an exposure amount giving an optical density of fog +0.2 indicated by luxsecond, based on sample No. 101.

The residual color after processing was visually observed, and evaluated by ⊙, ○, Δ, and X in the order of decreasing the residual color.

The results are shown in Table 1. As is apparent from the results shown in Table 1, the use of the compounds of the present invention results in increased sensitivity and decreased residual color after processing, and the tabular silver halide emulsions having high aspect ratio significantly increases the sensitivity.

EXAMPLE 2

Emulsion 2-A (High Aspect Ratio (111) Tabular Silver Chloride Grain Emulsion)

To 1.7 liter of water, 3.8 g of sodium chloride, 3.05 mmol of a compound shown below and 10 g of lime-treated ossein gelatin were added, and 28.8 ml of an aqueous solution of silver nitrate (silver nitrate: 7.34 g) and 28.8 ml of an aqueous solution of sodium chloride (sodium chloride: 2.71 g) were added to a vessel kept at 35° C. with stirring by the double jet method for one minute. Two minutes after the addition was completed, 188 g of a 10 wt % aqueous solution of trimellited gelatin obtained by trimelliting lime-treated ossein gelatin (trimellited rate: 98%) was added, followed by elevation of the temperature of the reaction vessel to 75° C. for 15 minutes. After ripening at 75° C. for 12 minutes, the temperature was lowered to 60° C. Then, 480 ml of a silver nitrate solution (silver nitrate: 122.7 g) and an aqueous solution of sodium chloride were added at an accelerated flow rate for 60 minutes. During this, the electric potential was maintained at +100 mV to a saturated calomel electrode.

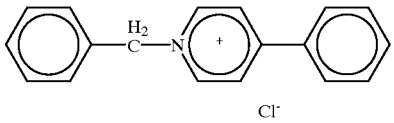

After the addition was completed, the temperature was lowered to 40° C., and an aqueous solution containing an anionic precipitant was added to make the total volume of 3 liters. Then, the pH was lowered using sulfuric acid until the emulsion was precipitated, thereby carrying out precipitation-washing.

After the washing was completed, 80 g of lime-treated gelatin, 85 ml phenol (5%) and 242 ml of distilled water were added, followed by dissolution and dispersion to adjust the emulsion to pH 6.2 and pAg 7.5. The resulting tabular grains had a mean equivalent-circle diameter of 1.7 μm, a mean thickness of 0.12 μm and a mean aspect ratio of 14.

Emulsion 2-B (Low Aspect Ratio (111) Tabular Silver Chloride Grain Emulsion)

To 1.7 liter of water, 3.8 g of sodium chloride, 1.5 mmol of the compound indicated by the above-mentioned formula (IIa) and 10 g of lime-treated ossein gelatin were added, and 28.8 ml of an aqueous solution of silver nitrate (silver nitrate: 7.34 g) and 28.8 ml of an aqueous solution of sodium chloride (sodium chloride: 2.71 g) were added to a vessel kept at 35° C. with stirring by the double jet method for one minute. Two minutes after the addition was completed, 188 g of a 10% aqueous solution of lime-treated ossein gelatin was added, followed by elevation of the temperature of the reaction vessel to 75° C. for 15 minutes. After ripening at 75° C. for 12 minutes, 480 ml of a silver nitrate solution (silver nitrate: 122.7 g) and an aqueous solution of sodium chloride were added at an accelerated flow rate for 39 minutes. During this, the electric potential was maintained at +150 mV to a saturated calomel electrode.

After the addition was completed, the temperature was lowered to 40° C., and an aqueous solution containing an anionic precipitant was added to make the total volume of 3 liters. Then, the pH was lowered using sulfuric acid until the emulsion was precipitated, thereby carrying out precipitation-washing.

After the washing was completed, 80 g of lime-treated gelatin, 85 ml phenol (5%) and 242 ml of distilled water were added, followed by dissolution and dispersion to adjust the emulsion to pH 6.2 and pAg 7.5. The resulting tabular grains had a mean equivalent-circle diameter of 1.2 μm, a mean thickness of 0.24 μm and a mean aspect ratio of 5.

The above-mentioned two emulsions were subjected to chemical ripening with stirring, maintaining the temperature at 60° C. First, fine pure silver bromide grains having an equivalent-sphere diameter of 0.05 μm were added in an amount of 0.01 mol per mol of silver chloride. After 10 minutes, each compound shown in Table 2 was added in an amount shown in Table 2, and optimum chemical sensitization was conducted with sodium thiosulfate and potassium chloroaurate.

TABLE 2

| | | Sensitizing Dye | | | | |
|---|---|---|---|---|---|---|
| Sample No. | Emulsion | Compound No. | Amount Added (mol/mol-Ag) | Sensitivity | Residual Color | Remark |
| 201 | 2-B | SS-1 | $6.3 \times 10^{-4}$ | 100 (Standard) | x | Comparison |
| 202 | " | (30) | " | 121 | Δ | Invention |
| 203 | " | (29) | " | 123 | Δ | Invention |
| 204 | " | (24) | " | 125 | ○ | Invention |
| 205 | " | (23) | " | 127 | ○ | Invention |
| 206 | " | (22) | " | 129 | ○ | Invention |
| 207 | " | (21) | " | 133 | ⊙ | Invention |
| 208 | " | (10) | " | 135 | ⊙ | Invention |
| 209 | " | (29) | " | 138 | ⊙ | Invention |
| 210 | " | SS-2 | " | 81 | x | Comparison |
| 211 | " | (6) | " | 101 | Δ | Invention |
| 212 | " | (5) | " | 103 | Δ | Invention |
| 213 | " | (4) | " | 104 | ○ | Invention |
| 214 | " | (3) | " | 104 | ○ | Invention |
| 215 | " | (2) | " | 106 | ⊙ | Invention |
| 216 | " | (1) | " | 110 | ⊙ | Invention |
| 217 | 2-A | SS-1 | $10.2 \times 10^{-4}$ | 141 | x | Comparison |
| 218 | " | (30) | " | 183 | Δ | Invention |
| 219 | 2-A | (29) | $10.2 \times 10^{-4}$ | 185 | Δ | Invention |
| 220 | " | (24) | " | 187 | ○ | Invention |
| 221 | " | (23) | " | 188 | ○ | Invention |
| 222 | " | (22) | " | 193 | ○ | *Invention |

TABLE 2-continued

| Sample No. | Emulsion | Sensitizing Dye: Compound No. | Sensitizing Dye: Amount Added (mol/mol-Ag) | Sensitivity | Residual Color | Remark |
|---|---|---|---|---|---|---|
| 223 | " | (21) | " | 194 | ○ | Invention |
| 224 | " | (20) | " | 196 | ◎ | Invention |
| 225 | " | (19) | " | 199 | ◎ | Invention |
| 226 | " | SS-2 | " | 120 | x | Comparison |
| 227 | " | (6) | " | 161 | Δ | Invention |
| 228 | " | (5) | " | 165 | ○ | Invention |
| 229 | " | (4) | " | 167 | ○ | Invention |
| 230 | " | (3) | " | 168 | ○ | Invention |
| 231 | " | (2) | " | 171 | ○ | Invention |
| 232 | " | (1) | " | 175 | ○ | Invention |

[Preparation of Coated Samples]

To 1307 g of each of the various emulsions subjected to chemical sensitization (containing 1 mol of silver), the following were added to prepare a coating solution.

| | |
|---|---|
| 14% Aqueous Solution of Inactive Gelatin | 756 g |
| Sodium Salt of 1-(3-sulfophenyl)-5-mercaptotetrazole | 0.12 g |
| Sodium Dodecylbenzenesulfonate | 1.44 g |
| Sodium Polystyrenesulfonate (average molecular weight: 600,000) | 1.44 g |
| $H_2O$ (to make the total volume of 4860 ml) | |

Triacetyl cellulose film supports having underlayers were each coated with the coating solutions and coating solutions for surface protective layers by the simultaneous extrusion method so as to give an amount of silver coated of 1.60 g/m$^2$, thereby preparing coated samples.

[Evaluation of Photographic Properties]

Each coated sample was exposed to a light source having a color temperature of 2854K through a filter allowing transmission of light having a wavelength of longer than 420 nm for 1 second. Then, the sample was developed with the following developing solution D19 at 25° C. for 5 minutes, and fixed with a Super Fujifix fixing solution manufactured by Fuji Photo Film Co., Ltd. for 30 seconds, followed by washing with water and drying.

| D19 Developing Solution | |
|---|---|
| Metol | 2.2 g |
| $Na_2SO_3$ | 96 g |
| Hydroquinone | 8.8 g |
| $NaCO_2.H_2O$ | 56 g |
| KBr | 5 g |
| $H_2O$ to make | 1000 ml |

For the developed films, the optical density was measured with a Fuji automatic densitometer. The fog was taken as the density of unexposed areas, and the sensitivity was indicated as the relative value of the reciprocal of an exposure amount giving an optical density of fog +0.2 indicated by luxsecond, based on sample No. 201. Further, the residual color after processing was visually observed, and evaluated by ◎, ○, Δ, and X in the order of decreasing the residual color.

The results are shown in Table 2. As is apparent from the results shown in Table 2, the use of the compounds of the present invention results in increased sensitivity and decreased residual color after processing, and the tabular silver halide emulsions having high aspect ratio significantly increases the sensitivity.

EXAMPLE 3

A tabular silver iodobromide emulsion was prepared as with emulsion D of Example 5 of JP-A-8-29904 to prepare Emulsion 3.

Multilayer color light-sensitive materials were prepared in the same manners as in sample 101 of Example 5 in JP-A-8-29904 except that Emulsion D of the fifth layer in sample 101 of Example 5 in JP-A-8-29904 was replaced by Emulsion 3, and ExS-1, 2 and 3 were replaced by Sensitizing dye (SS-1) ($5.0\times10^{-4}$ mol/mol-Ag) or Sensitizing dye (19) ($5.0\times10^{-4}$ mol/mol-Ag) to obtain Samples 301 and 302.

For examining the sensitivity of the samples thus obtained, the samples were exposed to light of Fuji FW sensitometer (Fuji Photo Film Co., Ltd.) through an optical wedge and a red filter for 1/100 second, and subjected to color development processing using the same processing processes and processing solutions as in Example 1 of JP-A-8-29904, followed by measurement of the cyan density. The sensitivity was indicated by a relative value of a fog density +0.2.

As a result, Sample 302 of the present invention showed a high sensitivity of 115, as compared with a sensitivity of 100 (standard) of Sample for comparison 301, and was also decreased in residual color after processing.

EXAMPLE 4

The tetradecahedral silver iodobromide emulsions were prepared in the same manner as in Emulsion 1 of Example 1 in JP-A-7-92601 except that the spectral sensitizing dye was replaced by Sensitizing dye (SS-2) ($8\times10^{-4}$ mol/mol-Ag) and sensitizing dye (1) ($8\times10^{-4}$ mol/mol-Ag), respectively, to obtain Emulsions 401 and 402, respectively. Further, the cubic silver iodobromide emulsions were prepared in the same manner as in Emulsion 1 of Example 1 in JP-A-7-92601 except that the silver potential during the second double jet was changed from +65 mV to +115 mV, and the spectral sensitizing dye was replaced by Sensitizing dye (SS-2) ($8\times10^{-4}$ mol/mol-Ag) and Sensitizing dye (1) ($8\times10^{-4}$ mol/mol-Ag), respectively, to obtain Emulsions 403 and 404.

Multilayer color light-sensitive materials were prepared in the same manner as in Sample 401 of Example 4 in JP-A-7-92601 except that Emulsion 1 of the ninth layer in Sample 401 of Example 4 in JP-A-7-92601 was replaced by Emulsions 401 and 402, respectively, to obtain Samples 411 and 412. Similarly, Emulsion 1 of the ninth layer in Example 4 in JP-A-7-92601 was replaced by Emulsions 403 and 404, respectively, to obtain Samples 413 and 414.

The sensitivity of the samples thus obtained was evaluated. Similarly to Example 4 in JP-A-7-92601, the samples were subjected to exposure for 1/50 second and color reversal development processing, and the yellow density was measured. For the sensitivity, the reciprocal of an exposure amount required to give an optical density of a minimum density obtained by sufficient exposure +0.2 was determined, and the sensitivity was indicated as a relative value to the value of Sample for comparison 411 which was taken as 100. As a result, Sample 412 of the present invention showed a high sensitivity of 128, and was also decreased in residual color after processing. Further, similarly, when the sensitivity of Sample for comparison 413 was taken as 100, Sample 414 of the present invention showed a high sensitivity of 119, and was also decreased in residual color after processing.

EXAMPLE 5

An octahedral internal latent image type direct positive silver bromide emulsion and a hexagonal tabular internal latent image type direct positive silver bromide emulsion were prepared in the same manner as in Emulsions 1 and 5 of Example 1 in JP-A-5-313297 to obtain Emulsions 501 and 502, respectively.

Color diffusion transfer photographic films were prepared in the same manner as in Sample 101 of Example 1 in JP-A-5-313297 except that Emulsion-2 of the nineteenth layer in Sample 101 of Example 1 in JP-A-5-313297 was replaced by Emulsion 501, and sensitizing dye (2) was replaced by Sensitizing dye (SS-2) ($9\times10^{-4}$ mol/mol-Ag) or Sensitizing dye (1) ($9\times10^{-4}$ mol/mol-Ag) to obtain Samples 511 and 512.

For examining the sensitivity of the samples thus obtained, the samples were processed using the same exposure, processing processes and processing solutions as in Example 1 of JP-A-5-313297, followed by measurement of the transfer density with a color densitometer. The sensitivity was indicated by the relative value of a density of 1.0. When the sensitivity of Sample for comparison 511 was taken as 100, Sample 512 of the present invention showed a high sensitivity of 121, and was also decreased in residual color after processing.

EXAMPLE 6

The silver chlorobromide emulsions were prepared in the same manner as in Emulsion F of Example 2 of JP-A-4-142536 except that red-sensitive Sensitizing dye (S-1) was not added before sulfur sensitization, and in addition to sulfur sensitization of triethylurea, chloroauric acid was also used in combination to optimally conduct gold-sulfur sensitization, and Sensitizing dye (SS-1) ($2\times10^{-4}$ mol/mol-Ag) and Sensitizing dye (19) ($2\times10^{-4}$ mol/mol-Ag) were each added after gold-sulfur sensitization, to obtain Emulsions 601 and 602, respectively.

Multilayer color light-sensitive materials were prepared in the same manner as in Sample 20 of Example 1 in JP-A-6-347944, except that the emulsion of the fifth layer in Sample 20 of Example 1 in JP-A-6-347944 was replaced by Emulsions 601 and 602, respectively, to obtain Samples 611 and 612.

For examining the sensitivity of the samples thus obtained, the samples were exposed to light of Fuji FW sensitometer (Fuji Photo Film Co., Ltd.) through an optical wedge and a red filter for 1/10 second, and subjected to color development processing using the same processing processes and processing solutions as in Example 1 of JP-A-6-347944. As a result, when the sensitivity of Sample for comparison 611 was taken as 100, Sample 612 of the present invention showed a high sensitivity of 127, and was also decreased in residual color after processing.

EXAMPLE 7

A tabular silver chloride emulsion was prepared as in Emulsion A of Example 1 in JP-A-8-122954, and subjected to the same chemical sensitization as chemical sensitization (B) of Example 1 in JP-A-8-122954 except that Sensitizing dye-1 was replaced by Sensitizing dye (SS-1) ($2\times10^{-4}$ mol/mol-Ag) and Sensitizing dye (19) ($2\times10^{-4}$ mol/mol-Ag), respectively, to obtain Emulsions 701 and 702, respectively.

For coated samples, the emulsion of Example 1 of JP-A-8-122954 was replaced by Emulsions 701 and 702, respectively, and the resulting emulsions were each applied onto both faces of a support in combination of an emulsion layer with a protective layer by the simultaneous extrusion method in the same manner as in Example 1 of JP-A-8-122954 to obtain Samples 711 and 712, respectively. The amount of silver coated per one face was 1.75 g/m$^2$.

For examining the sensitivity of the samples thus obtained, both faces of each sample were exposed using X-Ray Orthoscreen HGM manufactured by Fuji Photo Film Co., Ltd., and the samples were processed using an automatic processor and processing solutions in the same manner as with Example 1 of JP-A-8-122954. The sensitivity was indicated by the logarithm of the reciprocal of an exposure necessary to give a density of fog +0.1, and as a relative value taking the density of Sample 711 as 100. As a result, Sample 712 of the present invention showed a high sensitivity of 118, and was also decreased in residual color after processing.

The use of HR-4 or HGH instead of X-Ray Orthoscreen HGM used in exposure gave a similar effect.

EXAMPLE 8

The tabular silver chloride emulsion was prepared in the same manner as in Emulsion D of Example 2 of JP-A-8-227117 except that Sensitizing dyes-2 and 3 were not added to obtain Emulsion 801.

The coated samples were prepared in the same manner as in coated Sample F of Example 3 in JP-A-8-227117 except that Emulsion F of coated Sample F of Example 3 in JP-A-8-227117 was replaced by Emulsion 801, and Sensitizing dye-1 thereof was replaced by Sensitizing dye (SS-2) ($5\times10^{-4}$ mol/mol-Ag) and Sensitizing dye (1) ($5\times10^{-4}$ mol/mol-Ag), respectively, to obtain Samples 811 and 812, respectively.

For examining the sensitivity of the samples thus obtained, the samples were exposed to light of Fuji FW sensitometer (Fuji Photo Film Co., Ltd.) through an optical wedge and a blue filter for 1/100 second, and subjected to Fuji Photo Film CN16 processing to compare the photographic characteristics.

The sensitivity was indicated by the logarithm of the reciprocal of an exposure necessary to give a density of fog +0.2, and the density of Sample 811 was taken as 100. Sample 812 of the present invention showed a high sensitivity of 116, and was also decreased in residual color after processing.

EXAMPLE 9

The octahedral silver chloride emulsion was prepared in the same manner as in Emulsion F of Example 3 in JP-A-8-227117 to obtain Emulsion 901.

The coated samples were prepared in the same manner as in coated Sample F of Example 3 of JP-A-8-227117 except that Emulsion F of coated Sample F of Example 3 in JP-A-8-227117 was replaced by Emulsion 901, and Sensitizing dye-1 thereof was replaced by Sensitizing dye (SS-1) ($5\times10^{-4}$ mol/mol-Ag) and sensitizing dye (19) ($5\times10^{-4}$ mol/mol-Ag), respectively, to obtain Samples 911 and 912, respectively.

For examining the sensitivity of the samples thus obtained, the samples were exposed to light of Fuji FW sensitometer (Fuji Photo Film Co., Ltd.) through an optical wedge and a red filter for 1/100 second, and subjected to Fuji Photo Film CN16 processing to compare the photographic characteristics. The sensitivity was indicated by the logarithm of the reciprocal of an exposure necessary to give a density of fog +0.2, and the density of Sample 911 was taken as 100. Sample 912 of the present invention showed a high sensitivity of 124, and was also decreased in residual color after processing.

EXAMPLE 10

Tabular grain emulsions were prepared in the same manner as in Emulsion CC of European Patent 0699950 except that in chemical sensitization, $5\times10^{-4}$ mol/mol-Ag of Sensitizing dye (SS-1) was added instead of Dye 1 and Dye 8, and chemical sensitization was conducted. Thereafter, $3\times10^{-4}$ mol/mol-Ag of (SS-1) was added, and $3\times10^{-4}$ mol/mol-Ag of (SS-1) was further added to obtain Emulsion 1001. On the other hand, $5\times10^{-4}$ mol/mol-Ag of (19) was added, and chemical sensitization was performed. Thereafter, $3\times10^{-4}$ mol/mol of Ag of (19) was added, and $3\times10^{-4}$ mol/mol of Ag of (19) was further added to obtain Emulsion 1002.

The coated samples were prepared in the same manner as in the coated sample of examples of European Patent 0699950. A sample using Emulsion 1001 was named Sample 1001, and a sample using Emulsion 1002 was named Sample 1002. Exposure and development were also conducted in the same manner as with European Patent 0699950, and then the photographic characteristics were compared. The sensitivity was indicated by the logarithm of the reciprocal of an exposure necessary to give a density of fog +0.2, and as a relative value taking the density of Sample 1011 as 100. Sample 1012 of the present invention showed a high sensitivity of 121, and was also decreased in residual color after processing.

EXAMPLE 11

Emulsions 1, 2 and 3 were prepared by methods shown below.

(1) Preparation of Emulsion 1

A 1.9 M aqueous solution of $AgNO_3$ and a 1.9 M aqueous solution of KBr were added to an aqueous solution containing gelatin having an average molecular weight of 15000 (containing 1200 ml of water, 7.0 g of gelatin and 4.5 g of KBr) kept at 30° C. with stirring by the double jet method at 25 ml/minute for 70 seconds to obtain nuclei of tabular grains. Of this emulsion, 400 ml was used as seed crystals, and 650 ml of an aqueous solution of inactive gelatin (containing 20 g of gelatin and 1.2 g of KBr) was added thereto, followed by elevation of the temperature to 75° C. and ripening for 40 minutes. Then, an aqueous solution of $AgNO_3$ (containing 1.7 g of $AgNO_3$) was added for 1 minute and 30 seconds, and subsequently, 7.0 ml of an aqueous solution of $NH_4NO_3$ (50 wt %) and 7.0 ml of $NH_3$ (25 wt %) were added, followed by further ripening for 40 minutes.

Then, the emulsion was adjusted with $HNO_3$ (3 N) to pH 7, and 1.0 g of KBr was added thereto. Thereafter, 366.5 ml of a 1.9 M aqueous solution of $AgNO_3$ and an aqueous solution of KBr, subsequently, 53.6 ml of a 1.9 M aqueous solution of $AgNO_3$ and an aqueous solution of KBr (containing 33.3 mol % of KI), and 160.5 ml of a 1.9 M aqueous solution of $AgNO_3$ and an aqueous solution of KBr were added while maintaining the pAg at 7.9 to obtain Emulsion 1.

The resulting Emulsion 1 was triple structure grains having regions highest in silver iodide content in intermediate shells, and having a mean aspect ratio of 2.8. The ratio of tabular grains having an aspect ratio of 3 or more to the total projected area was 26%. The coefficient of variation in grain size was 7%, and the mean gain size was 0.98 $\mu$m in terms of the equivalent sphere diameter. After Emulsion 1 was desalted by an ordinary flocculation method, $4.1\times10^{-4}$ mol per mol of silver of a sensitizing dye was added, and gold-sulfur-selenium sensitization was optimally conducted in the presence thereof.

(2) Preparation of Emulsion 2

A 1.9 M aqueous solution of $AgNO_3$ and a 1.9 M aqueous solution of KBr were added to an aqueous solution containing gelatin having an average molecular weight of 15000 (containing 1200 ml of water, 7.0 g of gelatin and 4.5 g of KBr) kept at 30° C. with stirring by the double jet method at 25 ml/minute for 70 seconds to obtain nuclei of tabular grains. Of this emulsion, 350 ml was used as seed crystals, and 650 ml of an aqueous solution of inactive gelatin (containing 20 g of gelatin and 1.2 g of KBr) was added thereto, followed by elevation of the temperature to 75° C. and ripening for 40 minutes. Then, an aqueous solution of $AgNO_3$ (containing 1.7 g of $AgNO_3$) was added for 1 minute and 30 seconds, and subsequently, 6.2 ml of an aqueous solution of $NH_4NO_3$ (50 wt %) and 6.2 ml of $NH_3$ (25 wt %) were added, followed by further ripening for 40 minutes.

Then, the emulsion was adjusted with $HNO_3$ (3 N) to pH 7, and 1.0 g of KBr was added thereto. Thereafter, 366.5 ml of a 1.9 M aqueous solution of $AgNO_3$ and an aqueous solution of KBr, subsequently, 53.6 ml of a 1.9 M aqueous solution of $AgNO_3$ and an aqueous solution of KBr (containing 33.3 mol % of KI), and further 160.5 ml of a 1.9 M aqueous solution of $AgNO_3$ and an aqueous solution of KBr were added while maintaining the pAg at 8.3 to obtain Emulsion 2.

The resulting Emulsion 2 was triple structure grains having regions highest in silver iodide content in intermediate shells, and having a mean aspect ratio of 6.7. The ratio of tabular grains having an aspect ratio of 6 or more to the total projected area was 80%, and the ratio of tabular grains having an aspect ratio of 3 to 100 to the total projected area was 95%. The coefficient of variation in grain size was 11%, and the mean gain size was 1.00 $\mu$m in terms of the equivalent-sphere diameter.

After Emulsion 2 was desalted by an ordinary flocculation method, $5.4\times10^{-4}$ mol per mol of silver of a sensitizing dye was added, and gold-sulfur-selenium sensitization was optimally conducted in the presence thereof.

(3) Preparation of Emulsion 3

To 1.5 liters of a 0.8% solution of low molecular weight gelatin (molecular weight: 10,000) containing 0.05 mol of potassium bromide, 15 ml of a 0.5 M silver nitrate solution and 15 ml of a 0.5 M potassium bromide solution were added with stirring by the double jet method for 15 seconds. During this period, the gelatin solution was maintained at a temperature of 40° C. At this time, the pH of the gelatin solution was 5.0. After the addition, the temperature was elevated to 75° C. After 220 ml of a 10% trimellited gelatin solution (trimellited rate: 95%) was added, the emulsion was ripened for 20 minutes. Then, 80 ml of a 0.47 M silver nitrate solution was added.

After further ripening for 10 minutes, 150 g of silver nitrate and a potassium bromide solution containing 5 mol % of potassium bromide so as to keep the pBr at 2.55 were added at an accelerated flow rate (the flow rate at the time when addition was completed was 19 times the initial flow rate) by the controlled double jet method while maintaining the silver potential at 0 mV. After the addition was completed, 30 ml of a 10% KI solution was added. Then, after 1 N NaOH was added to adjust the pH of the emulsion to 7.2, 327 ml of a 0.5 M silver nitrate solution and 16.4 ml of a $10^{-2}$ M yellow prussiate solution were added, and 327 ml of a 0.5 M potassium bromide solution was added by the controlled double jet method for 20 minutes at an electric potential of 0 mV (shell formation). The emulsion was thereafter cooled to 35° C., and washed with water by an ordinary flocculation method. Then, 80 g of alkali-treated ossein gelatin deionized at 40° C. and 40 ml of a 2% $Zn(NO_3)_2$ solution was added and dissolved to adjust the pH to 6.5 and the pAg to 8.6, followed by storage thereof in a cool and dark location.

The resulting tabular grains were silver iodobromide grains having a coefficient of variation in equivalent-circle diameter of 15%, an equivalent circle diameter of 2.5 μm and a mean thickness of 0.10 μm (an aspect ratio of 25), and containing 5.7 mol % of silver iodide.

After Emulsion 3 was desalted by an ordinary flocculation method, $9.3\times10^{-4}$ mol per mol of silver of a sensitizing dye was added, and chemical sensitization was optimally conducted with sodium thiosulfate, potassium chloroaurate and potassium thiocyanate in the presence thereof.

(4) Preparation of Coated Samples

Emulsion layers and a protective layer shown in Table 3 were each formed on triacetyl cellulose film supports having underlayers to prepare samples.

TABLE 3

Coating Conditions of Emulsions (1) Emulsion Layer

Emulsion: Emulsion 1, 2 or 3 (refer to Table 4 for a dye used) ($2.1 \times 10^{-2}$ mol of silver/$m^2$)
Coupler ($1.5 \times 10^{-3}$ mol/$m^2$)

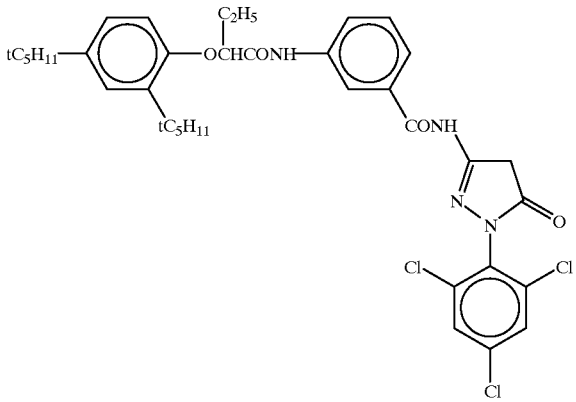

Tricresyl Phosphate (1.10 g/$m^2$)
Gelatin (2.30 g/$m^2$)

(2) Protective Layer

Sodium Salt of 2,4-Dichloro-6-hydroxy-s-triazine (0.08 g/$m^2$)
Gelatin (1.80 g/$m^2$)

Exposure for sensitometry (1/100 second) was given to these samples, which were subjected to the following color development processing.

Processing Method

| Stage | Processing Time (° C.) | Processing Temperature (ml) | Replenishment Rate (liter) | Tank Capacity |
|---|---|---|---|---|
| Color Development | 2 min and 45 sec | 38 | 33 | 20 |
| Bleaching | 6 min and 30 sec | 38 | 25 | 40 |

-continued

Processing Method

| Stage | Processing Time (° C.) | Processing Temperature (ml) | Replenishment Rate (liter) | Tank Capacity |
|---|---|---|---|---|
| Rinsing | 2 min and 10 sec | 24 | 1200 | 20 |
| Fixing | 4 min and 20 sec | 38 | 25 | 30 |
| Rinsing (1) | 1 min and 05 sec | 24 | countercurrent piping system from (2) to (1) | 10 |
| Rinsing (2) | 1 min and 00 sec | 24 | 1200 | 10 |
| Stabilization | 1 min and 05 sec | 38 | 25 | 10 |
| Drying | 4 min and 20 sec | 55 | — | — |

In the above Table, the replenishment rate is indicated by the a mount per a width of 35 mm and a length of 1 m.

The compositions of the processing solutions used are shown below:

| | Mother Liquor (g) | Replenisher (g) |
|---|---|---|
| (Color Developing Solution) | | |
| Diethylenetriaminepentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-N-Ethyl-N-p-hydroxyethylamino)-2-methylaniline Sulfate | 4.5 | 5.5 |
| Water to make | 1.0 liter | 1.0 liter |
| pH | 10.05 | 10.05 |
| (Bleaching Solution) | | |
| Sodium Ethylenediaminetetraacetato Ferrate Trihydrate | 100.0 | 120.0 |
| Disodium Ethylenediaminetetraacetate | 10.0 | 11.0 |
| Ammonium Bromide | 140.0 | 160.0 |
| Ammonium Nitrate | 30.0 | 35.0 |
| Aqueous Ammonia (27%) | 6.5 ml | 4.0 ml |
| Water to make | 1.0 liter | 1.0 liter |
| pH | 6.0 | 5.7 |
| (Fixing Solution) | | |
| Sodium Ethylenediaminetetraacetate | 0.5 | 0.7 |
| Sodium Sulfite | 7.0 | 8.0 |
| Sodium Bisulfite | 5.0 | 5.5 |
| Aqueous Solution of Ammonium Thiosulfate (70%) | 170.0 ml | 200.0 ml |
| Water to make | 1.0 liter | 1.0 liter |
| pH | 6.7 | 6.6 |
| (Stabilization Solution) | | |
| Formalin (37%) | 2.0 ml | 3.0 ml |
| Polyoxyethylene-p-monononyl Phenyl Ether (average degree of polymerization: 10) | 0.3 | 0.45 |
| Disodium Ethylenediaminetetraacetate | 0.05 | 0.08 |
| Water to make | 1.0 liter | 1.0 liter |
| pH | 5.8–8.0 | 5.8–8.0 |

For the processed samples, the density was measured through a green filter to evaluate the fresh sensitivity and residual color after processing.

The sensitivity was defined as the reciprocal of an exposure amount required to give a density of 2 higher than the fog density, and indicated as a relative value, taking the value of Sample 1111 as 100. Further, the residual color after processing was visually observed, and evaluated by ◎, ○, Δ, and X in the order of decreasing the residual color.

The emulsions and sensitizing dyes used in the respective samples, and results of the sensitivity and residual color of the respective samples are shown in Table 4 below.

TABLE 4

| | Emulsion 1 | | | Emulsion 2 | | | Emulsion 3 | | | |
|---|---|---|---|---|---|---|---|---|---|---|
| Sensitizing Dye | Sample No. | Sensitivity | Residual Color | Sample No. | Sensitivity | Residual Color | Sample No. | Sensitivity | Residual Color | Remark |
| SS-1 | 1111 (standard) | 100 | x | 1121 | 131 | x | 1131 | 170 | x | Comparison |
| (30) | 1112 | 113 | Δ | 1122 | 154 | Δ | 1132 | 214 | Δ | Invention |
| (29) | 1113 | 114 | Δ | 1123 | 156 | Δ | 1133 | 219 | ○ | Invention |
| (24) | 1114 | 114 | Δ | 1124 | 159 | ○ | 1134 | 223 | ○ | Invention |
| (23) | 1115 | 115 | ○ | 1125 | 161 | ○ | 1135 | 225 | ○ | Invention |
| (22) | 1116 | 117 | ○ | 1126 | 163 | ○ | 1136 | 230 | ◎ | Invention |
| (21) | 1117 | 118 | ○ | 1127 | 164 | ◎ | 1137 | 233 | ◎ | Invention |
| (20) | 1118 | 119 | ◎ | 1128 | 166 | ◎ | 1138 | 235 | ◎ | Invention |
| (19) | 1119 | 121 | ◎ | 1129 | 169 | ◎ | 1139 | 241 | ◎ | Invention |

As is apparent from the results shown in Table 4, the compounds of the present invention are high in fresh sensitivity and decreased in residual color, and an increase in aspect ratio of emulsions results in an significant improvement in sensitivity.

EXAMPLE 12

Synthesis of (19)

Sensitizing dye (19) was synthesized by a route of the following scheme 1.

Scheme 1

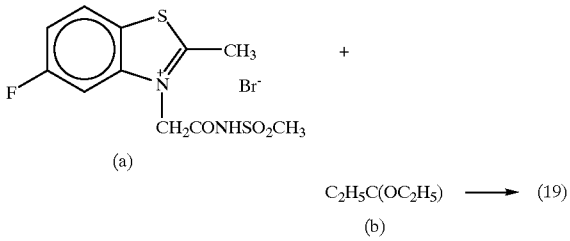

11.78 g (0.031 mol) of (a), 26.3 ml (0.1306 mol) of (b), 12 ml of acetic acid, 45 ml of pyridine and 4.6 ml of triethylamine were added, and heated at an outer temperature of 110° C. for 3 hours. After the reaction solution was allowed to cool, 1000 ml of ethyl acetate was added thereto, followed by decantation to obtain an oily material. Then, 100 ml of methanol and 2 ml of triethylamine were added to this oily material, which was completely dissolved by heating, followed by natural filtration. To the resulting filtrate, 5 ml of acetic acid was added, and the filtrate was allowed to cool. Precipitated crystals were separated by suction filtration. The same purification operation was repeated once, and the resulting crystals were dried to obtain 1.1 g of purple powder (19) (yield: 11%, δmax=552 nm, ϵ=1007000 (in methanol)).

According to the present invention, the silver halide photographic materials high in sensitivity and decreased in residual color can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one compound represented by the following formula (I):

(I)

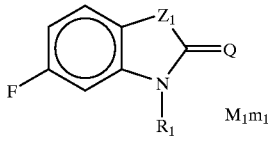

wherein $Z_1$ represents an oxygen atom or a sulfur atom; $R_1$ represents $CH_2CONHSO_2R_{11}$, $CH_2SO_2NHCOR_{12}$, $CH_2CONHCOR_{13}$ or $CH_2SO_2NHSO_2R_{14}$ (wherein $R_{11}$, $R_{12}$, $R_{13}$, and $R_{14}$ each represents an alkyl group, an aryl group, a heterocyclic group, an alkoxyl group, an aryloxy group, a heterocyclyloxy group or an amino group); Q represents a group necessary for forming a methine dye; $M_1$ represents a charge equilibrium counter ion; and $m_1$ represents the number necessary for neutralizing a charge of the molecule.

2. The silver halide photographic material as in claim 1, wherein the compound represented by formula (I) is selected from a compound represented by the following formula (II):

(II)

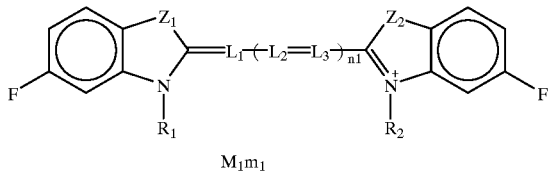

wherein $Z_1$, $R_1$ $M_1$ and $m_1$ each has the same meaning as given in formula (I); $Z_2$ represents an oxygen atom, a sulfur atom, a selenium atom, a tellurium atom, a carbon atom or a nitrogen atom; $R_2$ represents an alkyl group; $L_1$, $L_2$ and $L_3$ each represents a methine group; and $n_1$ represents 0, 1, 2 or 3.

3. The silver halide photographic material as in claim 1, wherein the compound represented by formula (I) is selected from a compound represented by the following formula (IIa):

(IIa)

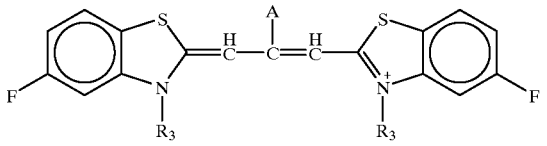

$M_1m_1$ wherein $M_1$ and $m_1$ each has the same meaning as given in formula (I); A represents a hydrogen atom, a methyl group, an ethyl group or a propyl group; and $R_3$ is represented by following $R_3$=$CH_2CONHSO_2CH_3$, $R_3$=$CH_2SO_2NHCOCH_3$, $R_3$=$CH_2CONHCOCH_3$, $R_3$=$CH_2SO_2NHSO_2CH_3$.

4. The silver halide photographic material as in claim 1, wherein said compound represented by formula (I) is contained in an emulsion layer comprising silver halide grains having a mean aspect ratio of from 3 to 1,000.

5. The silver halide photographic material as in claim 4, wherein said silver halide grains has a mean aspect ratio of from 8 to 100.

6. The silver halide photographic material as in claim 1, wherein the compound represented by formula (I) is a cyanine dye.

7. The silver halide photographic material as in claim 1, wherein the compound represented by formula (I) is a monomethine dye or a trimethine dye.

8. The silver halide photographic material as in claim 1, wherein Q in formula (I) has a benzothiazole nucleus or a benzoxazole nucleus.

* * * * *